US010018007B2

(12) United States Patent
Panicker-Shah

(10) Patent No.: US 10,018,007 B2
(45) Date of Patent: Jul. 10, 2018

(54) SYSTEMS AND METHODS TO VISUALIZE COMPONENT HEALTH AND PREVENTIVE MAINTENANCE NEEDS FOR SUBSEA CONTROL SUBSYSTEM COMPONENTS

(71) Applicant: Hydril USA Distribution, LLC, Houston, TX (US)

(72) Inventor: Kalpana Panicker-Shah, Houston, TX (US)

(73) Assignee: HYDRIL USA DISTRIBUTION LLC, Houston, TX (US)

( * ) Notice: Subject to any disclaimer, the term of this patent is extended or adjusted under 35 U.S.C. 154(b) by 29 days.

(21) Appl. No.: 14/588,564

(22) Filed: Jan. 2, 2015

(65) Prior Publication Data

US 2015/0184505 A1 Jul. 2, 2015

Related U.S. Application Data

(60) Provisional application No. 61/923,076, filed on Jan. 2, 2014.

(51) Int. Cl.
*E21B 34/16* (2006.01)
*E21B 41/00* (2006.01)
(Continued)

(52) U.S. Cl.
CPC ..... *E21B 33/0355* (2013.01); *E21B 34/16* (2013.01); *E21B 41/0007* (2013.01); *E21B 44/00* (2013.01)

(58) Field of Classification Search
CPC ..... E21B 33/0355; E21B 34/04; E21B 34/16; E21B 41/0007; E21B 44/00; E21B 47/12
(Continued)

(56) References Cited

U.S. PATENT DOCUMENTS 4,337,653 A 7/1982 Chauffe
5,278,549 A * 1/1994 Crawford ..... E21B 19/22 175/45
(Continued)

FOREIGN PATENT DOCUMENTS

CN 102539134 7/2012
CN 103033696 4/2013

OTHER PUBLICATIONS

Dry test—Googler Search.*
(Continued)

*Primary Examiner* — Gregory J Toatley
*Assistant Examiner* — Douglas Kay
(74) *Attorney, Agent, or Firm* — Hogan Lovells US LLP

(57) ABSTRACT

Systems and methods to visualize component health and preventive maintenance needs for subsea control subsystem components are provided. Embodiments can include energizing one or more solenoids, detecting a solenoid firing event, detecting activity in blowout preventer components downchain from the solenoids, and incrementing a cycle count for the one or more solenoids and each downchain blowout preventer component activated. Embodiments can include projecting a replacement date for the solenoid or any of the downchain blowout preventer components based on the cycle count and user-defined thresholds. In embodiments, a user is provided with an interactive graphical representation of a blowout preventer including selectable blowout preventer components thereby to visualize component health and preventive maintenance needs.

18 Claims, 26 Drawing Sheets

(51) Int. Cl.
*E21B 44/00* (2006.01)
*E21B 33/035* (2006.01)

(58) Field of Classification Search
USPC ..... 702/9, 183, 189; 166/363
See application file for complete search history.

(56) References Cited

U.S. PATENT DOCUMENTS 7,062,960 B2 6/2006 Couren
7,539,548 B2 5/2009 Dhawan
7,706,980 B2 * 4/2010 Winters ..... E21B 47/06 702/12
7,711,486 B2 5/2010 Thigpen
7,895,001 B2 2/2011 Tanju
8,149,133 B2 4/2012 Milne
8,403,053 B2 * 3/2013 Judge ..... E21B 33/0355 166/250.01
8,560,096 B1 * 10/2013 Chapman ..... G01F 1/00 166/250.01
8,560,098 B1 * 10/2013 Chapman ..... G01F 1/00 166/250.01
8,761,910 B1 * 6/2014 Chapman, Jr. ..... E21B 44/00 166/250.01
8,761,911 B1 * 6/2014 Chapman ..... E21B 44/00 166/250.01
8,781,743 B2 * 7/2014 McKay ..... E21B 33/064 175/25
2003/0182014 A1 * 9/2003 McDonnell ..... G05B 19/4065 700/159
2005/0222772 A1 10/2005 Koederitz
2007/0100478 A1 5/2007 Egeland
2008/0128138 A1 * 6/2008 Radi ..... E21B 19/004 166/350
2008/0177516 A1 * 7/2008 Vasudevan ..... B64F 5/0045 703/2
2008/0185143 A1 * 8/2008 Winters ..... E21B 33/064 166/250.07
2012/0132431 A1 5/2012 Ebenezer
2012/0197527 A1 * 8/2012 McKay ..... E21B 41/0007 702/6
2013/0054034 A1 * 2/2013 Ebenezer ..... E21B 33/06 700/282
2013/0169448 A1 7/2013 Kunchakoori
2013/0173168 A1 7/2013 Abitrabi
2013/0229286 A1 9/2013 Sanchez
2013/0245949 A1 9/2013 Abitrabi
2013/0307699 A1 11/2013 Brekke

OTHER PUBLICATIONS

Dry test—Google search.*
Difference between Wet and Dry lab_Major Differnces.*
Dry and wet test in oil and gas drilling—Google Search.*
International Search Report and Written Opinion issued in connection with corresponding PCT Application No. PCT/US2015/010038 dated Aug. 20, 2015.
Chinese Office Action dated Apr. 4, 2018 in correspondence Chinese Patent Application No. 201580003568.1.

* cited by examiner

Subsea Control System Health and Maintenance Admin

Dashboard (85) Events (86) Maintenance (87) POD View: Yellow Blue Active POD: Blue Active SEM: A POD Match

Power Back

UPS

| System State Description | Blue UPS Status | Yellow UPS Status |
|---|---|---|
| Inverter ON | NO | NO |
| State Switch Normal | NO | NO |
| Output Short Circuit | YES | YES |
| Inverter Shutdown - Fuse/OverTemp | YES | YES |
| Inverter Shutdown - Low Output Voltage | YES | YES |
| Inverter Shutdown - Bypass Breaker On | YES | YES |
| Inverter Shutdown - DC Over Voltage | YES | YES |
| Inverter Shutdown - Overload | YES | YES |
| Load 70% | YES | YES |
| Load 110% | YES | YES |
| Load 125% | YES | YES |

| System State Description | Blue UPS Status | Yellow UPS Status |
|---|---|---|
| Reverse Shutdown - Voltage Out of Range | YES | YES |
| Reverse Shutdown - Frequency Out of Range | YES | YES |
| Low Battery - Inverter Shutdown Imminent | YES | YES |
| Low Battery - Inverter Shutdown | YES | YES |
| Rectifier Shutdown - Voltage Out of Range | YES | YES |
| Phase Rotation Error | YES | YES |
| Rectifier Shutdown - DC Over Voltage | YES | YES |
| DC Over Voltage | YES | YES |
| Battery Charging | YES | YES |
| Battery Test | YES | YES |
| Emergency Stop Activated | YES | YES |

PDP

| | Blue UPS | | Yellow UPS | |
|---|---|---|---|---|
| **Blue Power Flag Alarms** | **120 VAC** | **24 V** | **120 VAC** | **24 V** |
| Blue CCU Equipment Cabinet Blue Power Flag Alarm | NOT OK | NOT OK | NOT OK | NOT OK |
| Yellow CCU Equipment Cabinet Blue Power Flag Alarm | NOT OK | NOT OK | NOT OK | NOT OK |

*FIG. 7*

Subsea Control System Health and Maintenance Tom Edison

Dashboard (85) Events (86) Maintenance (87) POD (SEM) View: Blue (SEM B) Yellow (SEM A) Active POD: Blue Active SEM: A POD Match

Rig Name Enterprise & Ram Details Back

| | *Blind Shear RAMs* | *Casing Shear RAMs* | *Upper Pipe RAM* | *Middle Pipe RAM* | *Lower Pipe RAM* | *SSTV RAM* | *Status* |
|---|---|---|---|---|---|---|---|
| Back Lash: FWD | | | | | | | |
| Back Lash: AFT | | | | | | | |
| LVDT Coefficient - Volts to Length | | | | | | | |
| LVDT Offset: FWD | | | | | | | |
| LVDT Offset: AFT | | | | | | | |
| LVDT Total Length | | | | | | | |
| LVDT Span: FWD | | | | | | | |
| LVDT Span: AFT | | | | | | | |

*FIG. 12*

Subsea Control System Health and Maintenance

Maintenance Report

Print Export

2102

June 15th - July 15th

| ID | Description | Assy Part # | RK Part # | Serial Kitt # | Maint Type | Date | Status |
|---|---|---|---|---|---|---|---|
| 01 | Shear Seal Valves 3 AutoShear Control Reset | BC729 | BC729-RK | BC729-SK | Repair | 7/15/2014 | OVERDUE |
| 76 | Shear Seal Valves 4 Man Reg Pres INC | VR463 | VR463-RK | VR463-SK | Repair | 8/15/2014 | OK |
| 20 | Shear Seal Valves 5 Man Reg Pres DEC | PQ249 | PQ249-RK | PQ249-SK | Repair | 8/17/2014 | OK |
| 13 | Shear Seal Valves 6 UA Reg Pres INC | FF361 | FF361-RK | FF361-SK | Repair | 8/18/2014 | OK |
| 03 | Shear Seal Valves 7 UA Reg Press DEC | W029 | W029-RK | W029-SK | Replace | 12/20/2015 | OK |
| 14 | Shear Seal Valves 8 Acoustic Boom - EXTEND | DP775 | DP775-RK | DP775-SK | Replace | 12/21/2015 | OK |
| 15 | Shear Seal Valves 9 Acoustic Stab - EXTEND | SP341 | SP341-RK | SP341-SK | Replace | 12/23/2015 | OK |
| 19 | Shear Seal Valves 10 LMRP Disk Ind Valve | DQ567 | DQ567-RK | DQ567-SK | Replace | 12/23/2015 | OK |
| 62 | Shear Seal Valves 11 Mud Boost Valve - OPEN | CD051 | CD051-RK | CD051-SK | Replace | 12/24/2015 | OK |

2100

*FIG. 21*

SYSTEMS AND METHODS TO VISUALIZE COMPONENT HEALTH AND PREVENTIVE MAINTENANCE NEEDS FOR SUBSEA CONTROL SUBSYSTEM COMPONENTS

RELATED APPLICATIONS

The present application is a non-provisional application which claims priority to and the benefit of U.S. Provisional Application No. 61/923,076, filed on Jan. 2, 2014 and titled "Systems, Computer Programs, and Methods of Providing Data Visualization for Health Monitoring and Preventive Maintenance Decision-Making for Subsea Control Subsystem Components," the disclosure of which is incorporated herein in its entirety.

BACKGROUND OF THE INVENTION

Field of the Invention

This invention relates generally to subsea control subsystem management, and in particular to the health and maintenance of control subsystem components.

Description of the Related Art

Conventional drilling control system design allows data collection on a drilling rig. Current drilling control systems are capable of communicating remotely from a central location to rigs enabled with a remote services network. Generally, this network is primarily used to manage limited remote troubleshooting and to download software updates. Collected data, however, generally is confined to a particular drilling rig both in terms of acquisition and interpretation. Recently, there has been a new focus in the industry on ensuring relevant data is available and transmitted off the drilling rig to a shore-based location.

SUMMARY OF THE INVENTION

Recognized by the Applicant, however, is that there is no high-quality tool to visualize physical subsea control system components and record usage data of those components by the drilling control system in terms of counting cycles from the time of installation of a component, trending "normal" operational readings from the components after installation, or other data reporting that would aid a customer in identifying deviations from normal operating conditions. Additionally, Applicant has recognized there is presently a need for a high-quality and enhanced tool that allows a user to readily identify corrective actions and report on upcoming maintenance needs for subsea equipment.

Applicant further has recognized a need for an innovative system, method, and program product including an easy-to-use intelligent customer interface that can be installed on a customer's drilling vessel to provide maintenance metrics, equipment diagnostic trends, and facilitate off-rig remote monitoring and diagnosis (RM&D) efforts.

In view of the foregoing, embodiments of the present invention advantageously provide systems, methods, and computer medium having computer programs stored therein (program products) to allow high quality and enhanced visualization of component health and preventive maintenance needs for subsea control subsystem components. Embodiments of systems, methods, and program products also advantageously can convert existing component data into actionable advice to help customers reduce non-productive time by providing remote visibility into the health of a blowout preventer (BOP) stack, reducing downtime associated with accessing and trending BOP data, and optimizing maintenance to reduce unnecessary parts replacements. Various embodiments of the invention additionally can collect key BOP control system data and provide context to identify corrective actions, thereby leading to faster troubleshooting and decision making.

Various embodiments of the invention also advantageously can provide visibility into major components' replacement needs and storage of corrective maintenance data. Various embodiments of the systems, methods, and program products can provide cycle counting of hydraulic components (not immediately actuated by a solenoid) based on an indication of energization of a solenoid coil of a solenoid in a BOP component chain and an indication of a pressure transducer associated with a downchain activity. Embodiments can detect actual downchain activity and not apply such count based solely on solenoid coil energization, e.g., as a result of testing of the solenoid coil actuating hydraulic components, in order to provide for accurate condition-based maintenance. Hydraulic components downchain from the solenoid can include, for example, shear seal valves, sub-plate mounted (SPM) valves, multiple position locking (MPL) components, flow meters, high-temperature and high-pressure probes, transducers, ram packers, packing units, shuttle valves, and regulators.

Further, various embodiments of the invention advantageously provide an easy-to-use web-based solution that can be installed on a drilling rig and can provide communication to onshore engineers via a customer's/provider's intranet. These solutions, for example, advantageously can provide for troubleshooting of BOP health, events filtering, and remote visualization, and can provide condition-based maintenance for major components to provide system health to onshore engineers for better decision-making.

According to an embodiment, condition monitoring and maintenance can provide the user information on the condition of BOP components prone to single point of failures. The main components of the blowout preventer can include: solenoid valves and associated solenoids, shear seal valves, SPM valves, MPL components, flow meters, high-pressure and high-temperature probes, transducers, ram packers, packing units, shuttle salves, and regulators.

According to an embodiment, computer programs of the program products can provide part replacement advice based on the cycle counts or the current/temperature/pressure rating for these components based on operator manual requirements. The user also can be able to trend values over time for specific components based on values in a datalogger.

More specifically, an example of an embodiment of a method visualize status of component health and preventive maintenance needs for subsea control subsystem components can include the steps of detecting a solenoid firing event, logging the firing event in a table of a datalogger, determining if a control pod (multiplexer unit that controls valves and other components on the BOP stack) is an active or non-active pod of a pair of pods, and determining if a firing event was a dry test, a wet test or actual event. If the firing event is determined to be a wet test or an actual event, the method further can include incrementing a cycle count for a plurality of associated components in a chain of hydraulic component activation associated with a certain BOP stack function. If the firing event is determined to be a dry test, the method further can include incrementing a cycle count for a subset of less than all of the plurality of associated components in the chain of hydraulic component activation.

According to an embodiment, cycles are counted for every function call that is fired by a solenoid. As such, the solenoid firing count is linked to each component for which it is firing. According to this embodiment, for example, cycle counts for components associated with a firing of a certain solenoid can take into account all the components that are present in the hydraulic circuit to the firing of a stack function. For example, when a solenoid fires, the shear seal valve actuates a pilot signal which is sent to an SPM valve which, in turn, sends hydraulic fluid to the shuttle valve, which, operably moves an actual stack function, e.g., closing of an annular BOP. In this example, the chain would be: solenoid-shear seal valve-SPM valve-shuttle valve. This chain of hydraulic component activation on the firing circuit can eventually increment the counter for each particular component and calculate replacement advice based on a maximum cycle count.

According to an exemplary configuration, log data including pressures associated with the annular ram and indicia of energization of the solenoid coil of a certain solenoid associated with a certain component chain are accessed as input for the computer programs, which provide an output in the form of incrementing a certain count for each component in the component chain in response to both energization of the solenoid and a coinciding change in pressure associated with closing of the ram. If only energization of the solenoid coil is logged without a corresponding change in pressure, only the total number of cycles for the solenoid can be incremented.

Report output for such exemplary configuration can include a total number of cycles of the respective components. Maintenance is based, for example, off of a maximum number permissible which can be identified and continuously updated based on bench testing data and examination of a replaced component. A spreadsheet/tabular type form can be provided which lists each component in a number of cycles left until maintenance is required, along with a projection of when that date will be reached based on average usage or an anticipated usage based on a profile such as time of the year, type of activity being performed on the well, etc.

In embodiments of systems, methods, and program products, a user, for example, can receive automatic alerts under certain circumstances. For example, the automatic alerts can relate to and be sent responsive to the cycle count of the solenoid or any of the downchain BOP components. The automatic alerts can be configured to be sent to a user when a cycle count reaches a predefined threshold, when a cycle count comes within a certain number of a predefined threshold, when a system determines that the solenoid or a downchain BOP component must be replaced, or when the system determines that the solenoid or a downchain BOP component must be replaced within a predefined number of days.

In embodiments of systems, methods, and program products, automatic alerts can relate to and be sent responsive to a parameter associated with one or more of the plurality of downchain BOP components. For example, an automatic alert can be sent responsive to a solenoid overcurrent or undercurrent if the current respectively exceeds or drops below a predefined value. The automatic alert also can be sent responsive to fluctuations in the solenoid current if fluctuations in the solenoid current exceed a predefined value. In embodiments, an automatic alert also can occur if pressure in the regulators exceeds a predefined value. In addition, automatic alerts can be sent if any of the system's transducers or other components behave abnormally.

It will be understood by one skilled in the art that steps and operations disclosed herein can be carried out by a plurality of dedicated modules initiated by one or more processors upon execution of a set of instructions stored in a tangible computer-readable medium. Hence, an embodiment can provide a system to visualize status of component health and preventive maintenance needs for subsea control subsystem components. The system can include a blowout preventer and one or more solenoid valves operably disposed within the blowout preventer (BOP) such that the one or more solenoid valves close upon energization of one or more solenoids respectively associated with one or more solenoid valves. The system also can include one or more pressure transducers operably connected to a plurality of downchain BOP components and configured to indicate activity of individual BOP components. In addition, the system can include a pair of control pods, or multiplexer units that control valves and other components of the BOP. The pair of control pods can include an active pod and a non-active pod. The system further can include one or more processors in communication with tangible computer-readable medium. The computer-readable medium can have stored therein a plurality of operational modules, each including a set of instructions that when executed cause the one or more processors to perform operations. For example, embodiments can include a solenoid energization detection module responsive to the energization of the one or more solenoid and configured to detect a solenoid firing event upon energization of the solenoid. The system further can include a datalogger module responsive to the solenoid energization detection module and configured to log the solenoid firing event in a table of a datalogger. In embodiments, the system can include a control pod status module configured to determine whether a control pod is an active pod or a non-active pod. In addition embodiments can include an event detection module responsive to the datalogger module, the control pod status module, and indications obtained from the one or more pressure transducers and being configured detect a type of solenoid firing event, the type of solenoid firing event, for example, including one of a dry test, a wet test, and an actual event. Moreover, in an embodiment of a system, the plurality of modules further can include a cycle count module responsive to the solenoid energization detection module and the event detection module and configured to increment a cycle count for each of the one or more solenoids and the plurality of downchain BOP components in a chain of hydraulic component activation associated with a predefined BOP function if the solenoid firing event is detected as a wet test or an actual event. The cycle count module further can be configured to increment a cycle count for each of the one or more solenoids and a subset of the plurality of downchain BOP components in the chain of hydraulic component activation associated with a predefined BOP function if the solenoid firing event is detected as a dry test.

Various embodiments of systems, methods, and program products discussed herein allow high quality and enhanced visualization of component health and preventive maintenance needs for subsea control subsystem components. Moreover, embodiments of systems, methods, and program products can convert existing component data into actionable advice to help customers reduce non-productive time by providing remote visibility into the health of a blowout preventer (BOP) stack, reducing downtime associated with accessing and trending BOP data, and optimizing maintenance to reduce unnecessary parts replacements. Further, various embodiments of the invention additionally can collect key BOP control system data and provide context to identify corrective actions, thereby leading to faster troubleshooting and decision making. Hence, embodiments of the invention address a number of problems recognized by Applicant, as will be discussed more thoroughly herein.

BRIEF DESCRIPTION OF THE DRAWINGS

So that the manner in which the features and advantages of embodiments of the invention, as well as others which will become apparent, may be understood in more detail, a more particular description of the invention briefly summarized above may be had by reference to the embodiments thereof which are illustrated in the appended drawings, which form a part of this specification. It is to be noted, however, that the drawings illustrate only various embodiments of the invention, and, therefore, are not to be considered limiting of the invention's scope as it may include other effective embodiments as well.

FIG. 7 is an illustration of a power systems, webpage according to an embodiment of the present invention;

FIG. 12 is an illustration of a ram block details section of a webpage according to an embodiment of the present invention;

FIG. 21 is an illustration of a maintenance report webpage according to an embodiment the present invention;

DETAILED DESCRIPTION

Figure 1:
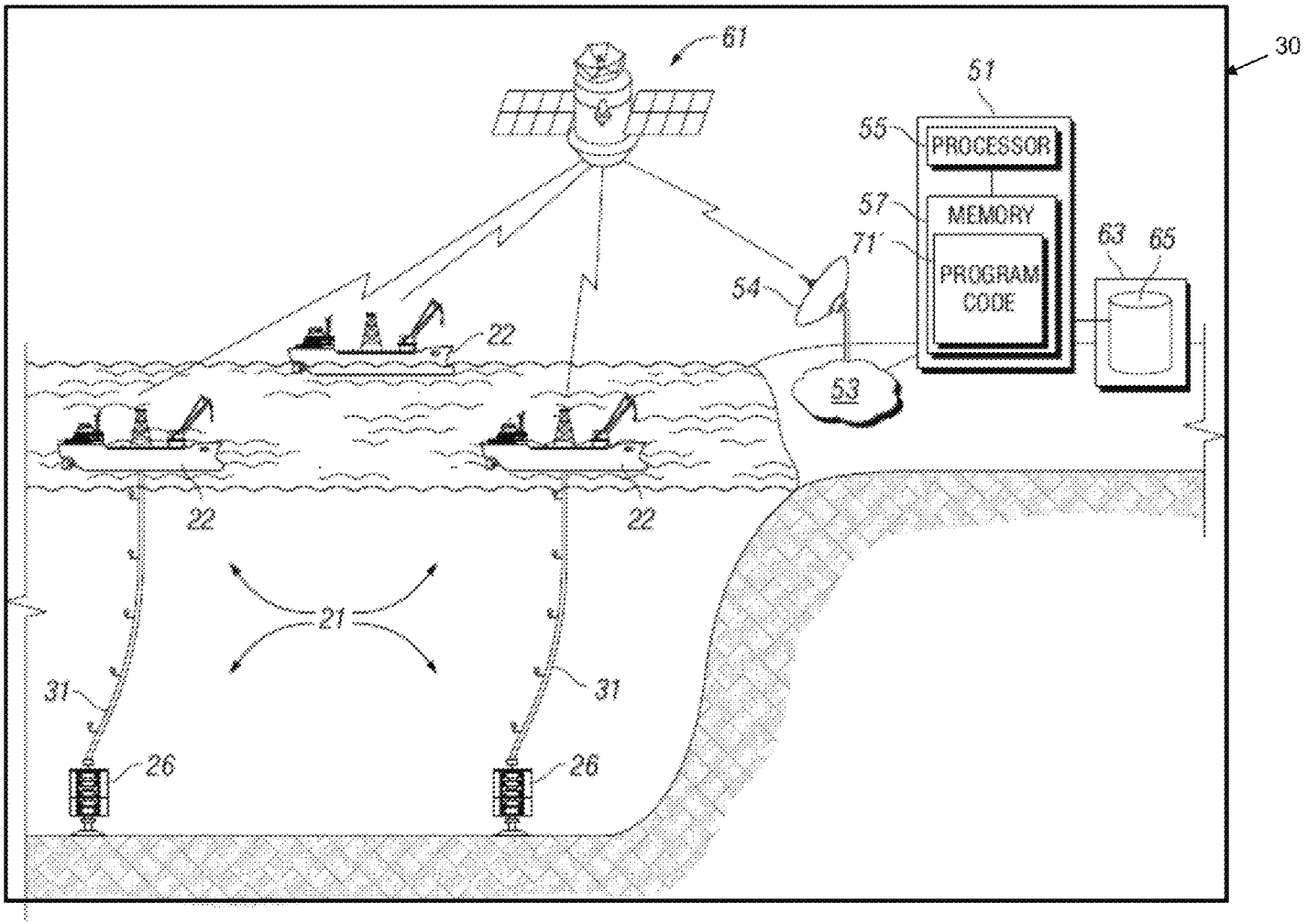
FIG. 1 is a graphical image of surface and subsea systems, according to an embodiment of the present invention.

The present invention will now be described more fully hereinafter with reference to the accompanying drawings, which illustrate embodiments of the invention. This invention, however, may be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout. Prime notation, if used, indicates similar elements in alternative embodiments.

Various embodiments or the invention provide an integrated platform that provides a robust user interface, which allows the user to view the data contents of the drilling control system data logger in a user-friendly manner to provide diagnostic and maintenance tools to assess the performance and health of drilling system components, and enable transmission of the data, reports, and screens to a remote location, such as, for example, either a customer or service provider location. Various embodiments can utilize available historical data, alarms management information, diagnostic/prognostic rules, high-level data (data run in/out), a heat map for subsea electronics modules (SEMs), and availability/reliability calculations, for example, based on an internal reliability study. Various embodiments also can provide historical data, cycle counts/cycles remaining reporting, performance monitoring/trending, electronic health snapshots, fleet statistics/comparisons, and integration with customer maintenance management solution systems. Various embodiments also can provide operation support including local viewing of data, remote viewing of data, ask an expert, inventory availability, inventory, ordering and e-invoicing. Various embodiments also can provide unit history, including parts replacements, stack configuration, as-built bill of materials (BOM), as-running BOMs, service maximums, and parts repairs.

More specifically, FIGS. 1-5 illustrate a plurality of offshore drilling and/or production systems 21, and a data visualization for component health and preventive maintenance needs system 30 to remotely manage subsea control subsystem components (surface and subsea subsystems, but primarily the BOP stack subsystem) positioned at one or more separate vessel/drilling/production system locations, according to an embodiment of the present invention. The drilling and/or production system 21 can include a free floating/anchored platform or other vessel 22, a subsea wellhead system, and a riser system 31 extending therebetween. For simplicity, FIG. 1 does not include a detailed illustration of a subsea wellhead system. Instead, a BOP 26 is shown at the bottom of each riser. It will be understood by one skilled in the art that a BOP 26 is typically part of a larger wellhead system not shown.

Figure 2:
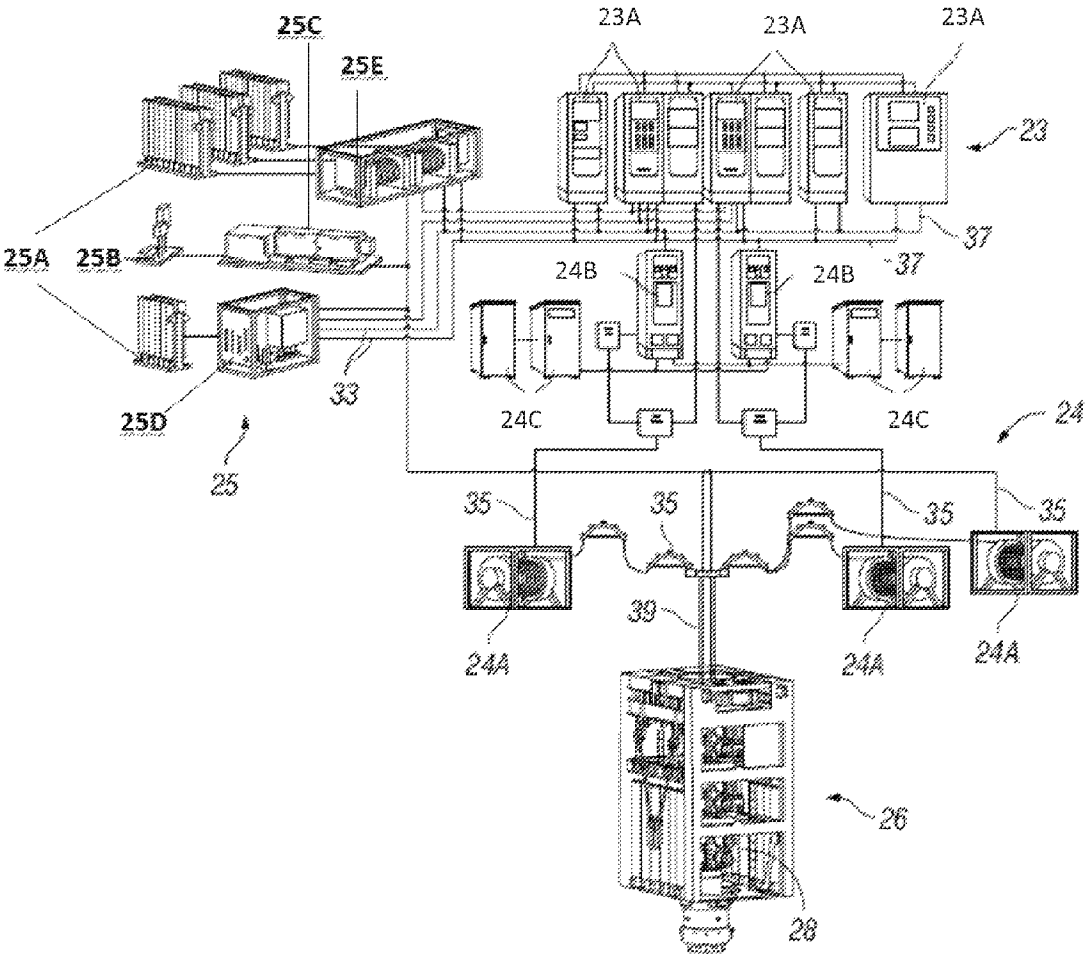
FIG. 2 is a schematic diagram of a general system architecture of a system for providing data visualization of component health and preventive maintenance needs for subsea control subsystem components according to an embodiment of the present invention.

FIG. 2 illustrates various subsystems that can be carried by the vessel 22. The vessel 22 can carry communications subsystems 23, electric power subsystems 14, and hydraulic subsystems 25. The subsea wellhead system can also include a lower marine riser package 31 (FIG. 1) and blowout preventer 26. A communications subsystem 23 can take various configurations as known and understood by those skilled in the art. In embodiments, the communications subsystem can include data terminals and communications servers 23A. Communication lines 37, including, for example, power lines, fiber optic cables and other communication lines known in the art, can be used to transfer communications data to and from the communications subsystem 23 and other subsystems 24, 25. In embodiments of the system, an electric power subsystem 24 can include electric generators 24A and electrical control system components 24B, 24C to route electrical power. It will be understood by one skilled in the art that the electric power subsystem can include other components, such as batteries or vessel-based solar arrays. Power lines 35 can be used to transfer power from the electric generators 24A, or other components of the electric power subsystem 24, to the BOP 26 or to other subsystems 23, 25. in addition, embodiments can include hydraulic subsystems 25. Hydraulic subsystems 25 can take many configurations as will be understood by one skilled in the art. For example, in embodiments of the system, a hydraulic subsystem 25 can include hydraulic control valves 25 to control the routing of hydraulic fluid. A hydraulic subsystem farther can include a pressure regulator 25B, hydraulic motor 25C, and hydraulic control system elements 25D, 25E. Hydraulic lines 33 can be used to route hydraulic power to the BOP. The subsea portions of the hydraulic lines 33, power lines 35, and communications lines 37 can be disposed within one or more durable cable housings 39, 39' to achieve access to the BOP thereby to protect the various lines 33, 35, 37 from pressure-related and other natural elements existing in the subsea environment.

Figure 3:
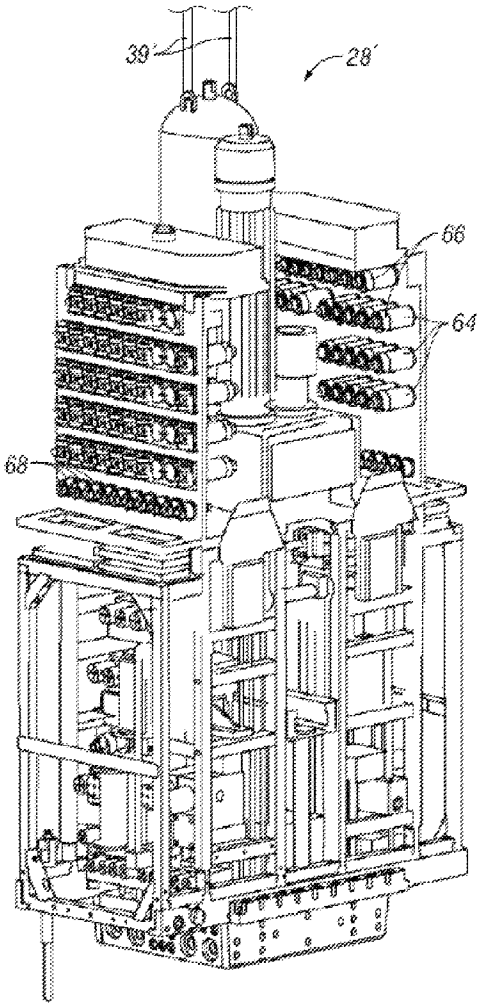
FIG. 3 illustrates a portion of a blowout preventer including a plurality of solenoid valves and a plurality of pressure transducers.

FIG. 3 illustrates a BOP interior portion 28' according to an embodiment of the system. The BOP interior portion 28' shown in FIG. 3 includes a plurality of solenoid valves 64 and a plurality of pressure transducers 68. An array of solenoid valves 64 and an array of pressure transducers 68 can be used as pictures. Many configurations of one or more solenoid valves 64 and one or more pressure transducers 68 can be used without such configurations falling outside the scope of the invention. Disposed within each solenoid valve 64 is a solenoid 66. A solenoid valve 64 closes upon energization of its respective solenoid 66.

Figure 4:
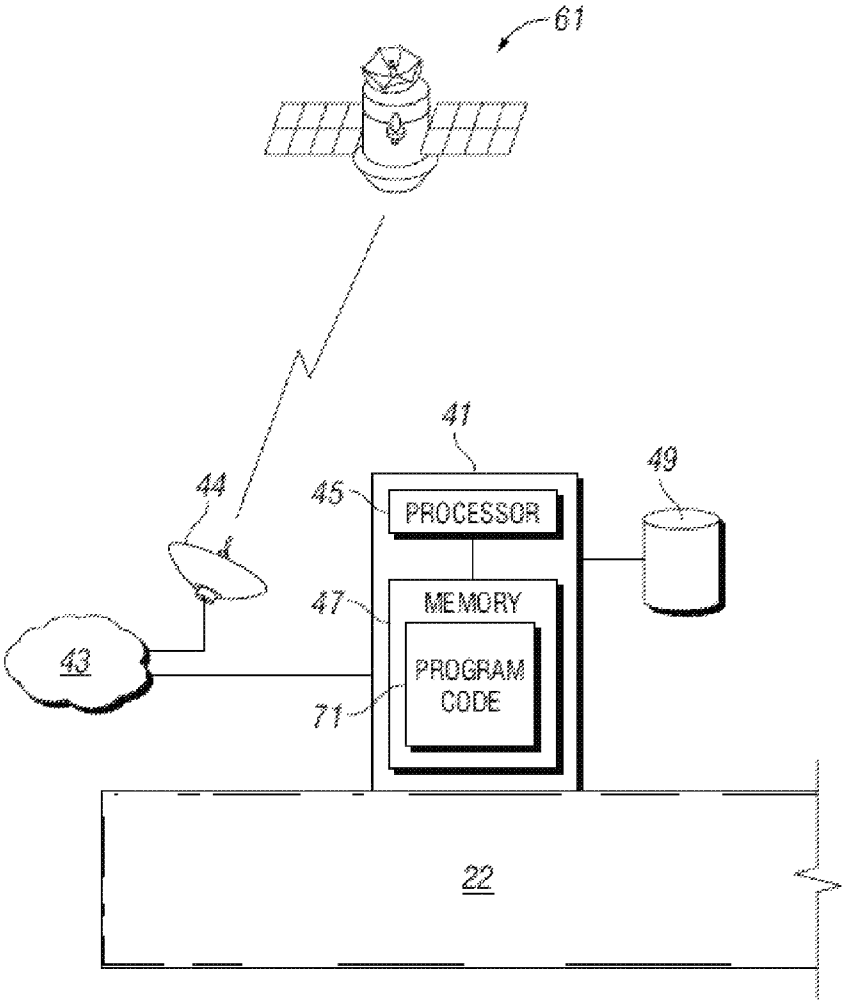
FIG. 4 is a schematic diagram of a general system architecture of vessel-based components of the system of FIG. 2 according to an embodiment of the present invention.
Figure 5:
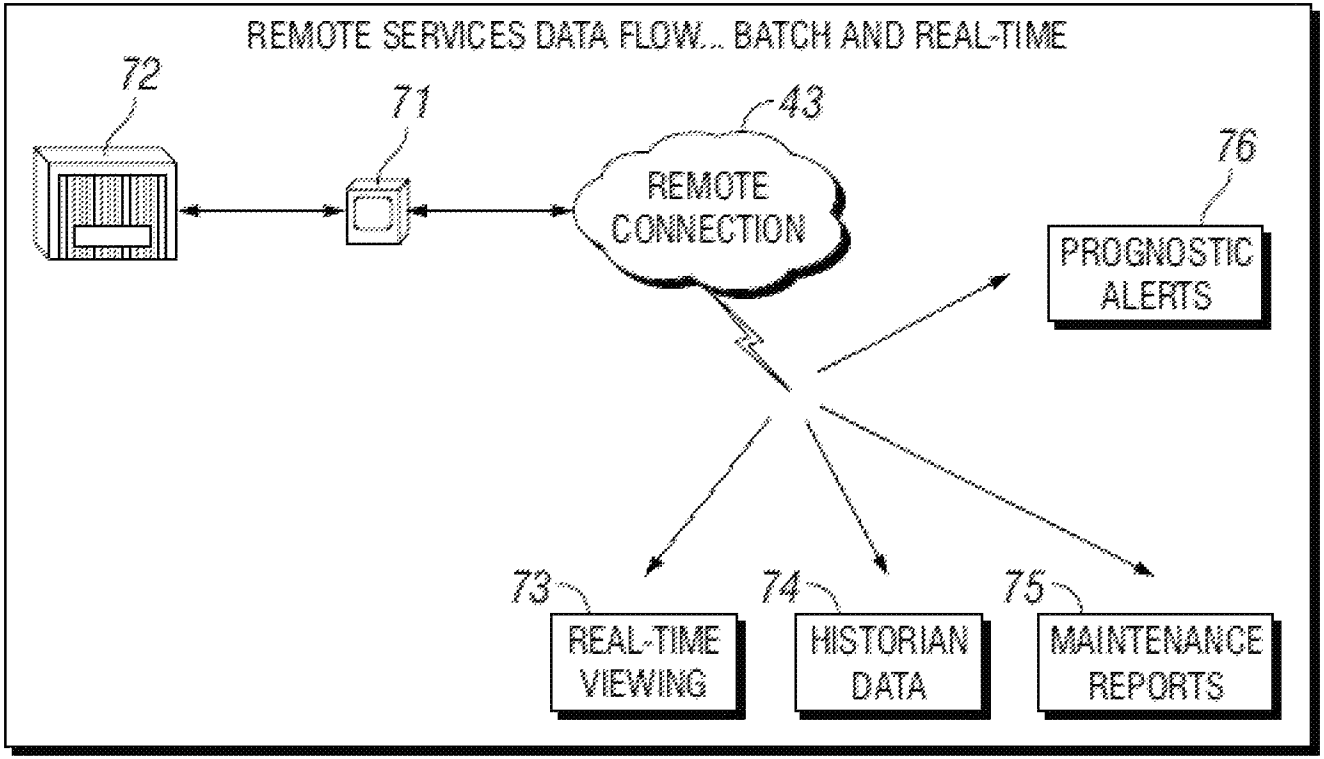
FIG. 5 is a schematic diagram illustrating various functions of a subsea control system health and maintenance management program.

Referring to FIG. 4, the vessel 22 also can include a shipboard computer 41 in communication with a local shipboard communication network 43 e.g., a Local Area Network (LAN), which is in communication with the control system data logger 72 (FIG. 5). The shipboard computer 41 can include a processor 45 and memory 47 coupled to the processor 45. Also in communication with the shipboard communication network 43 is a receiver/transmitter 44 providing, for example, satellite-based communication to onshore facilities through a satellite 61. At least one database 49 accessible to the processor 45 of the shipboard computer 41 also can be provided, which can be utilized to store subsea control system component information.

Referring to FIGS. 4 and 5, as will be described in more detail below, the shipboard computer 41 can include a subsea control system health and maintenance management program 71, which can retrieve data from a multiplexer (MUX) data logger 72 (FIG. 5). The shipboard computer 41, can comprise an industrial computer (PC) to deliver computing capability and data storage necessary to provide a robust user interface to: view the contents of the drilling system data logger 72 in a user-friendly manner; provide diagnostic and maintenance tools to assess the performance and health of drilling system components; and enable transmission of the data, reports, and screens to a remote location.

According to an exemplary configuration, the subsea control system health and maintenance management program 71, in conjunction with one or more shipboard computers 41 and associated subcomponents form a system drilling information system, which receives input data from a MUX data logger 72. In embodiments of the system, data is processed and web-based access is provided via a remote connection 43 to remotely-located user computers capable of displaying the various health conditions and maintenance analytics in order to provide time of replacement advice thereby to reduce inventory costs. According to such a configuration, a remote user can initiate various functions of the subsea control system health and maintenance management program 71. These functions can include, for example, real-time viewing 73 of visual depictions of the BOP and each of its various components thereby to allow online troubleshooting. A user can also view historian data 74, thereby to provide a user with raw data indicating, for example, when maintenance was last scheduled for each of various BOP components and providing details on such maintenance. Maintenance data can also be viewed in maintenance reports 75, providing maintenance data organized by date, type, BOP component or other user-defined parameters. The maintenance reports 75 further can inform a user what maintenance steps should be taken the next time the BOP is retrieved. In embodiments, a remote user can receive prognostic alerts 76 through the subsea control system health and maintenance management program 71 thereby providing a user with fault warnings, outage alerts, and other alerts. In embodiments, such prognostic alerts 76 are created responsive to user input. Additionally, in embodiments, prognostic alerts 76 can be generated automatically.

Returning to FIG. 1, according to an embodiment of the present invention, the visualization of component health and preventive maintenance needs system 30 can include portions onshore and portions at each of the vessel locations 22. The portion of the system 30 located at an onshore or other centralized location or locations can include at least one computer to remotely manage subsea control system assets for a plurality of separate vessel locations defining a subsea control system asset management server 51 positioned in communication with an onshore local area communication network 53. The subsea control system asset management server 51 can include a processor 55 and memory 57 coupled to the processor 55. Also in communication with the onshore communication network 53 is a receiver/transmitter 54 providing, for example, satellite-based communication to a plurality of vessels/drilling/production facilities 21 each having a receiver/transmitter 44. This portion of the system 30 can also include a global communication network 61 providing a communication pathway between the shipboard computers 41 of each respective vessel 22 and the subsea control system asset management server 51 to permit transfer of subsea control system asset information between the shipboard computers 41 and the subsea control system asset management server 51.

The memory 45, 55 can include volatile and nonvolatile memory known to those skilled in the art including, for example, RAM, ROM, and magnetic or optical disks, to name just a few. It also should be understood that the preferred onshore server and shipboard computer configuration is given by way of example in FIGS. 1 and 4 and that of types of servers or computers configured according to various other methodologies known to those skilled in the art can be used. Particularly, the server 51, shown schematically in, for example, FIG. 1 can represent a server or server cluster or server farm, or even a simple laptop computer, a tablet computer, or mobile device, and is not limited to any individual physical server or computer. The server site may be deployed as a server farm or server cluster managed by a server hosting provider. The number of servers and their architecture and configuration may be increased based on usage, demand and capacity requirements for the system 30. Similarly, the shipboard computer 41 can include a single computer, typically having multiple processors, or multiple computers configured for individual use or as servers.

The system 30 also can include a data warehouse or other data storage facility 63, which can store relevant data on every piece of data visualization for component health and preventive maintenance needs system-equipped riser components anywhere in the world. The data warehouse 63 is assessable to the processor 55 of the subsea control system asset management server 51 and can be implemented in hardware, software, or a combination thereof. The data warehouse 63 can include at least one centralized database 65 configured to store subsea control system health and maintenance information for the components of a plurality of subsea control systems and other assets of interest deployed at a plurality of separate vessel locations. The asset in formation can include, for example, the part number, serial number, relevant manufacturing records, operational procedures, component utilization, temperature, pressure, voltage of transducers, solenoid current, fired status, etc., including others provided by a MUX data logger 72 as would be understood by those of ordinary skill in the art, and all maintenance records (including detailed information on the nature of the maintenance), to name just a few. The database 65 can retain all information acquired automatically from shipboard computers 41. The shipboard computers 41, in turn, can retrieve the data from the data logger 72 (see, e.g., FIG. 5) for processing and transmission to the subsea control system asset management server 51.

Various embodiments of the present invention include the subsea control system health and maintenance management program 71, (FIGS. 4-5) stored in the memory 47 of the shipboard computer 41 to monitor and manage a plurality of subsea control system assets assigned to the specific vessel 22 and/or subsea control system asset management program 71' (FIG. 1) stored in the memory 57 of the subsea control system health and maintenance management server 55 to monitor and manage the health and maintenance of a plurality of subsea control system assets positioned at a plurality of separate vessel locations (e.g., on or deployed by each vessel 22). As many of the program product elements executed by the shipboard computers 41 and the subsea control system asset management server 51 can be similar in function, the program product elements primarily will be described with respect to those either solely or jointly executed by the shipboard computer 41. It will be understood by one skilled in the art, however, that many of the program product elements disclosed herein may be executed by the shipboard computers 41, the subsea control system asset management server 51, or jointly by these two.

The subsea control system health and maintenance management program 71 and the subsea control system asset management program 71' can be in the form of microcode, programs, routines, and symbolic languages that provide a specific set or sets of ordered operations that control the functioning of the hardware and direct its operation, as known and understood by those skilled in the art. Neither the subsea control system health and maintenance management program 71 nor the subsea control system asset management program 71', according to an embodiment of the present invention, need to reside in their entirety in volatile memory, but can be selectively loaded, as necessary, according to various methodologies as known and understood by those skilled in the art. Further, the subsea control system health and maintenance management program 71 and subsea control system asset management program 71' each include various functional elements as will be described in detail below, which have been grouped and named for clarity only. One skilled in the art will understand that the various functional elements need not physically be implemented in any hierarchy, but readily can be implemented as separate objects or macros. Various other conventions can be utilized as well, as would be known and understood by one skilled in the art.

According to an embodiment of the present invention, the subsea control system health and maintenance management program 71, or alternatively, the subsea control system asset management program 71 can include a data module, a troubleshooting/analytic module, and/or a maintenance module 1900. The data module can contain an electronic snapshot of the entire control system, providing an ability to visualize the data in the data logger and troubleshoot issues. This can include the ability to trend multiple charts at one time based on the historical data and also the ability to access data remotely. An analytics module of either program 71, 71' can provide reliable estimates on equipment failure based on operating parameters and historical data analysis. This section can incorporate predictive algorithms to ascertain the condition of critical components. A troubleshooting module can provide a user remote access to the BOP, an electronic snapshot of BOP health, access to subsystem screens, the ability to search events based on type, time, pod or subsea electronics module (SEM), and the ability to view multiple trends for troubleshooting. The maintenance module 1900 can provide the user visibility into the replacement needs for major components, filtering of components, the input and storage of corrective maintenance data, and report generation. The maintenance module 1900 can be aimed primarily to control effectively the supply of equipment to reduce inventory cost. This can include providing replacement advice for major components by certain days (e.g., 30, 60, 90, 180 days) based on the condition of a component.

According to an embodiment of the present invention, the subsea control system health and maintenance management program 71 comprises instructions, that when executed by the shipboard computer 41 either automatically or on-demand from one or more remote user computers, perform health monitoring and visualization functions and maintenance tracking, predictive analysis, and scheduling. The subsea control system health and maintenance management program 71 can provide: fleet level analytics including the side-by-side comparison of like data between similar vessels 22 in a network, pressure, flowmeter, or real-time ram block position and pressure parameter comparison, fault tree analysis of the data to identify deviations and corrections, a degradation mechanism based on failure mode effects analysis (FMEA)/failure mode effects and criticality analysis (FMECA) for each rig, and a central repository 65 for data (e.g., data in the cloud).

According to an exemplary configuration of the subsea control system health and maintenance management program 71, a web-based user is provided a login screen through utilization of user management-Lightweight Directory Access Protocol (LDAP)/active directory integration. Once logged in, a user can access a graphical user interface displaying a dashboard page 85, which can provide a visual illustration of the health of the BOP stack, the health of subsystems, current states of each element in the subsystems, and trends of the data.

According to an exemplary configuration, a plurality of dashboard pages can be provided, which can be structured to provide access to subsystem health and details screens and a graphical representation 82 of a BOP stack. The graphical representation of a BOP stack can reflect conditions, such as open, closed, unlocked, locked, normal or check conditions for annulars, riser connector, rams, and stack connectors. The graphical representation 82 of a BOP stack further can read back pressures for annulars, risers, manifold regulators, and stack connector regulators via a main page. Graphical representations 82 of these and other various BOP components range from generic representations of those components to visual depictions of the actual BOP components pre-installation according to user needs. For example, embodiments may include visual depictions of a BOP, wherein various components of the BOP are selectable through a graphical user interface (GUI). The GUI can provide for blown-up and interactive views of selected BOP components thereby to indicate health of particular subcomponents of the BOP components or the health of BOP components generally and to provide specific maintenance steps needed in a visual, interactive setting. Other exemplary dashboard pages can include pod (SEM) view, active pod view (displayed, for example, as blue/yellow), subsea electronics module (SEM) (A/B) view, and pod match visibility, said dashboard pages capable of being provided via user-selectable page links.

Figure 6:
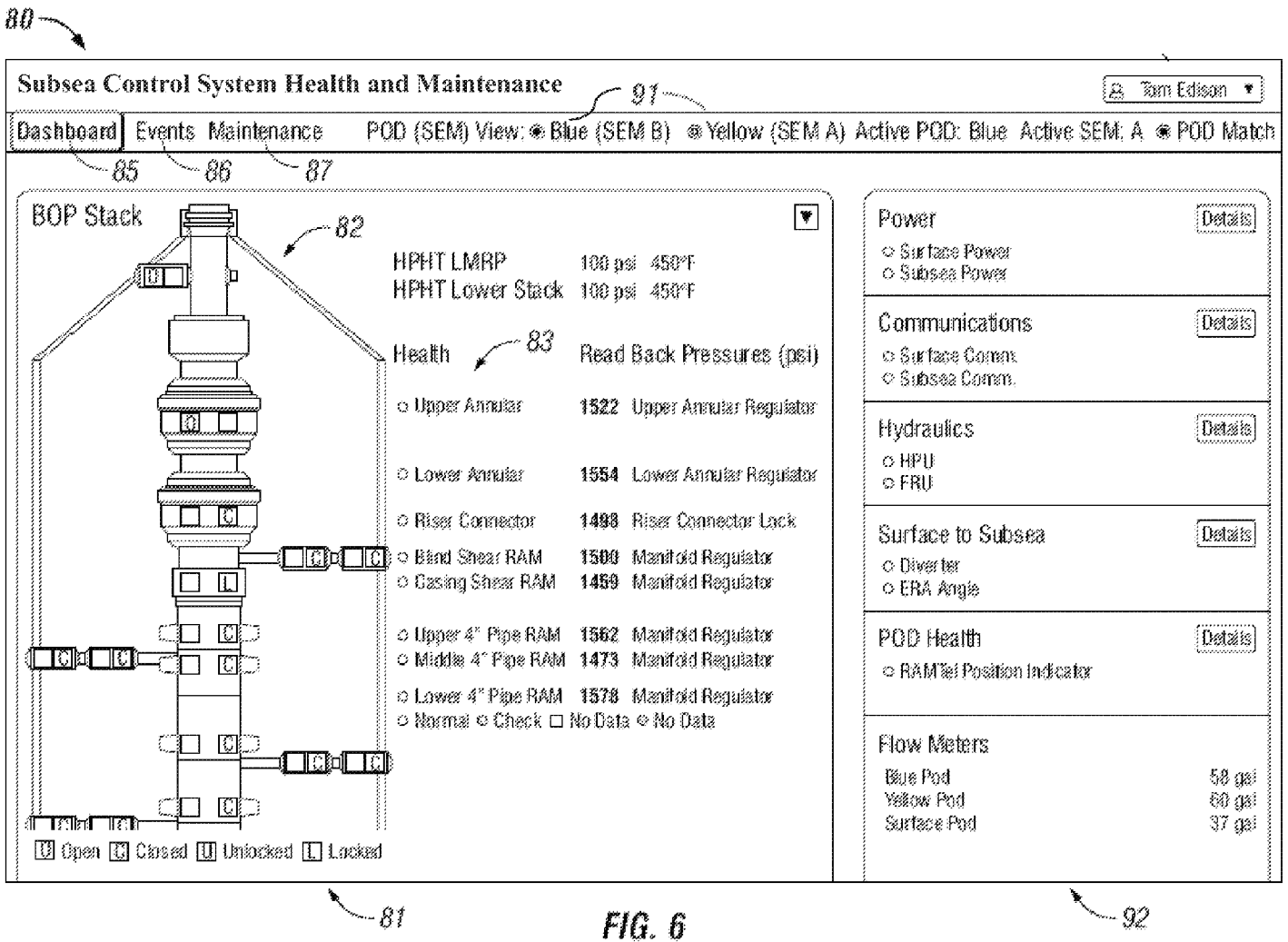
FIG. 6 is an illustration of an interactive graphical user interface defining a dashboard page according to an embodiment of the present invention.

FIG. 6 illustrates an exemplary dashboard page 80. The left panel 81 shows the current state and health of the BOP Stack 82, and sub-system health snapshots 83. Beneficially, according to this exemplary configuration, the health of the blowout preventers in the BOP stack 82 and individual components easily can be determined visually through use of traffic light colors like green, yellow, etc. The navigation bar 84 can allow the user to switch between the dashboard 85, events 86, and maintenance main pages 87. On the right hand side of the navigation bar there can be a toggle 91 that allows a user to switch between the blue and yellow pod to view data from each of the pods. It also displays which pod and SEM are active in the control system. A pod match alarm also can be present to indicate a mismatch in the pod data. The right-hand panel 92 can allow for selecting power, communications, hydraulics, surface-to-subsea, pod health, and real-time ram block data dashboard pages and to view flowmeter flow rates for the blue, yellow, and surface pods.

FIG. 7 illustrates an exemplary power system page. This page can provide details about the surface and subsea power subsystems. Detailed information for a universal power supply, power distribution panels, SEM voltages and ground fault detection can be provided.

Figure 8:
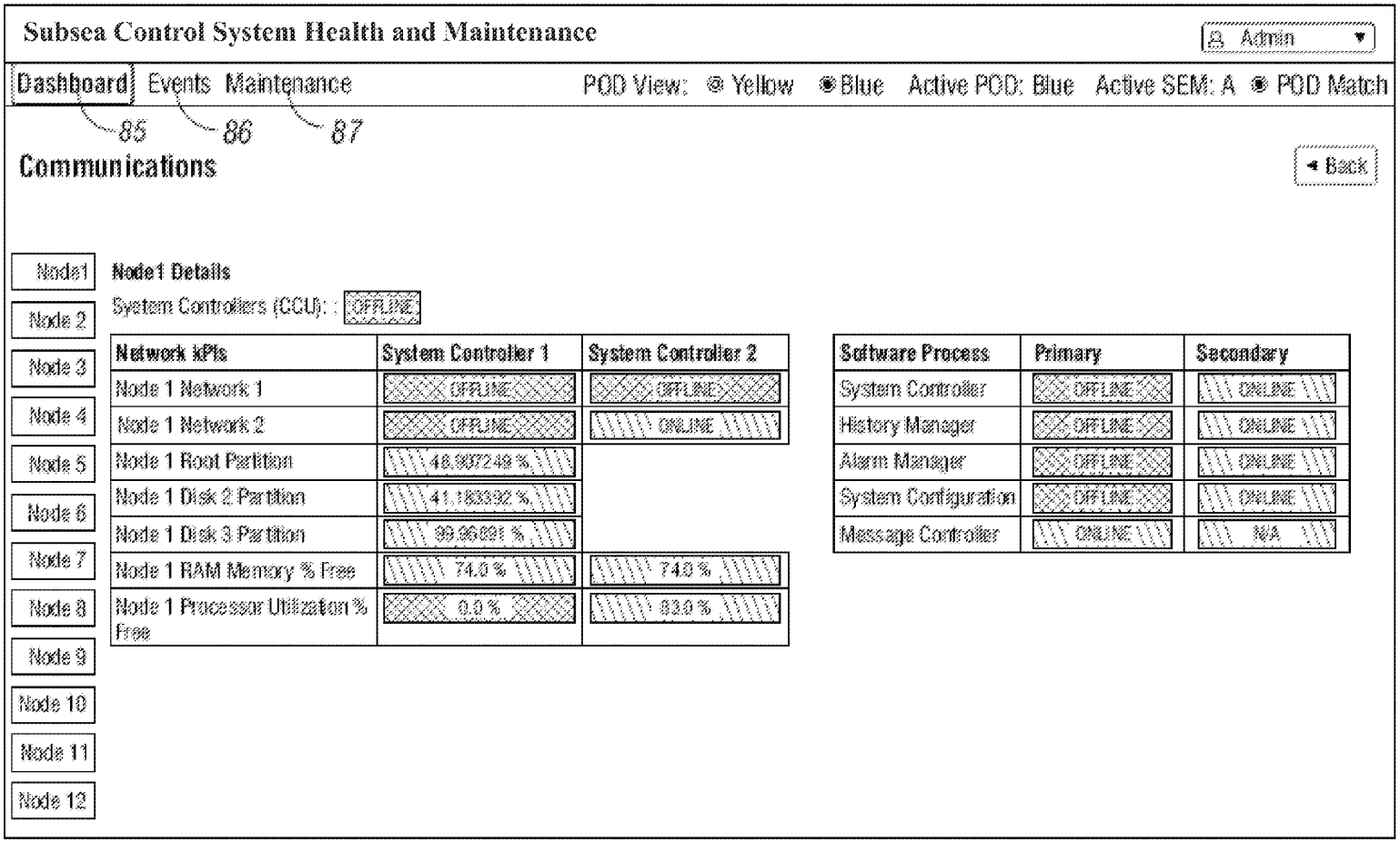
FIG. 8 is an illustration of an exemplary communication sub-system webpage according to an embodiment of the present invention.

FIG. 8 illustrates an exemplary communication subsystem page. This page can provide information on all network key performance indicators (KPIs) and program product processes running on each node in a computer control unit.

Figure 9:
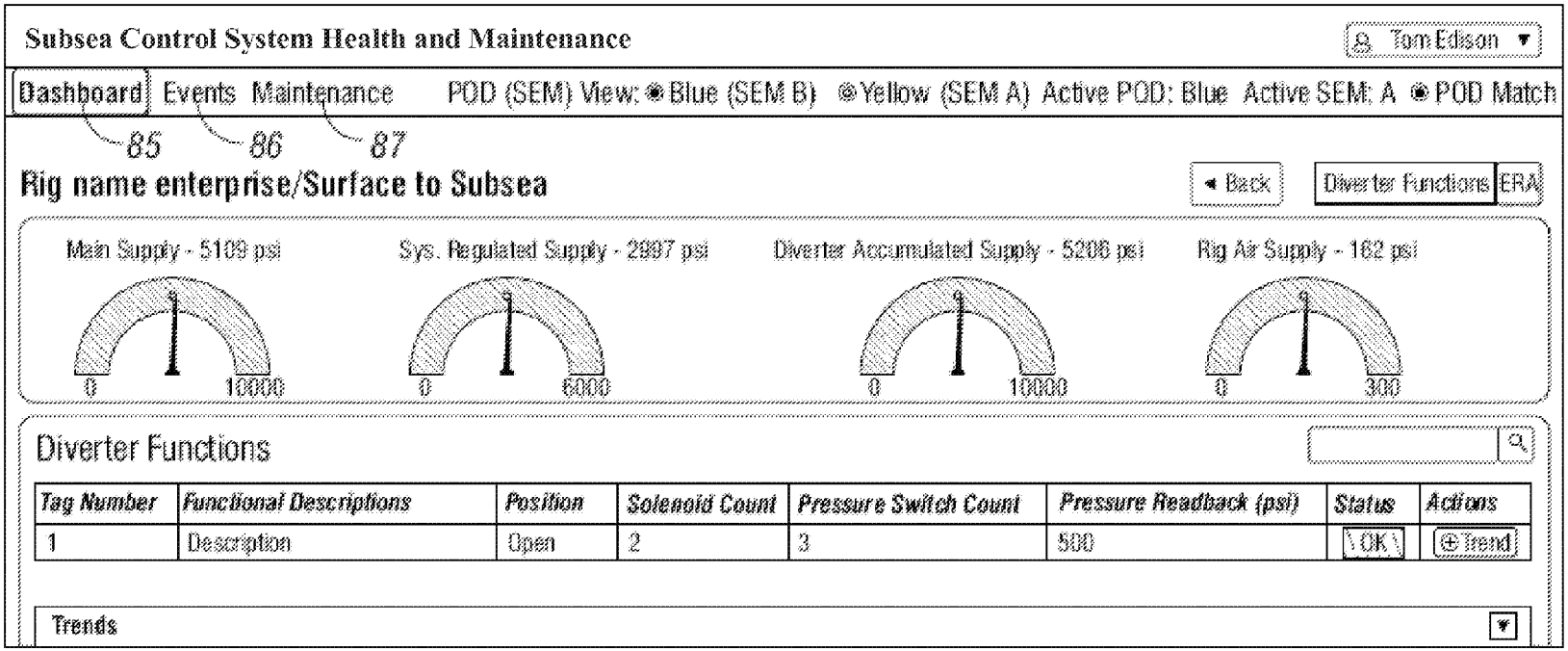
FIGS. 9 and 10 collectively illustrate an exemplary surface-to-subsea section of a webpage according to an embodiment of the present invention.
Figure 10:
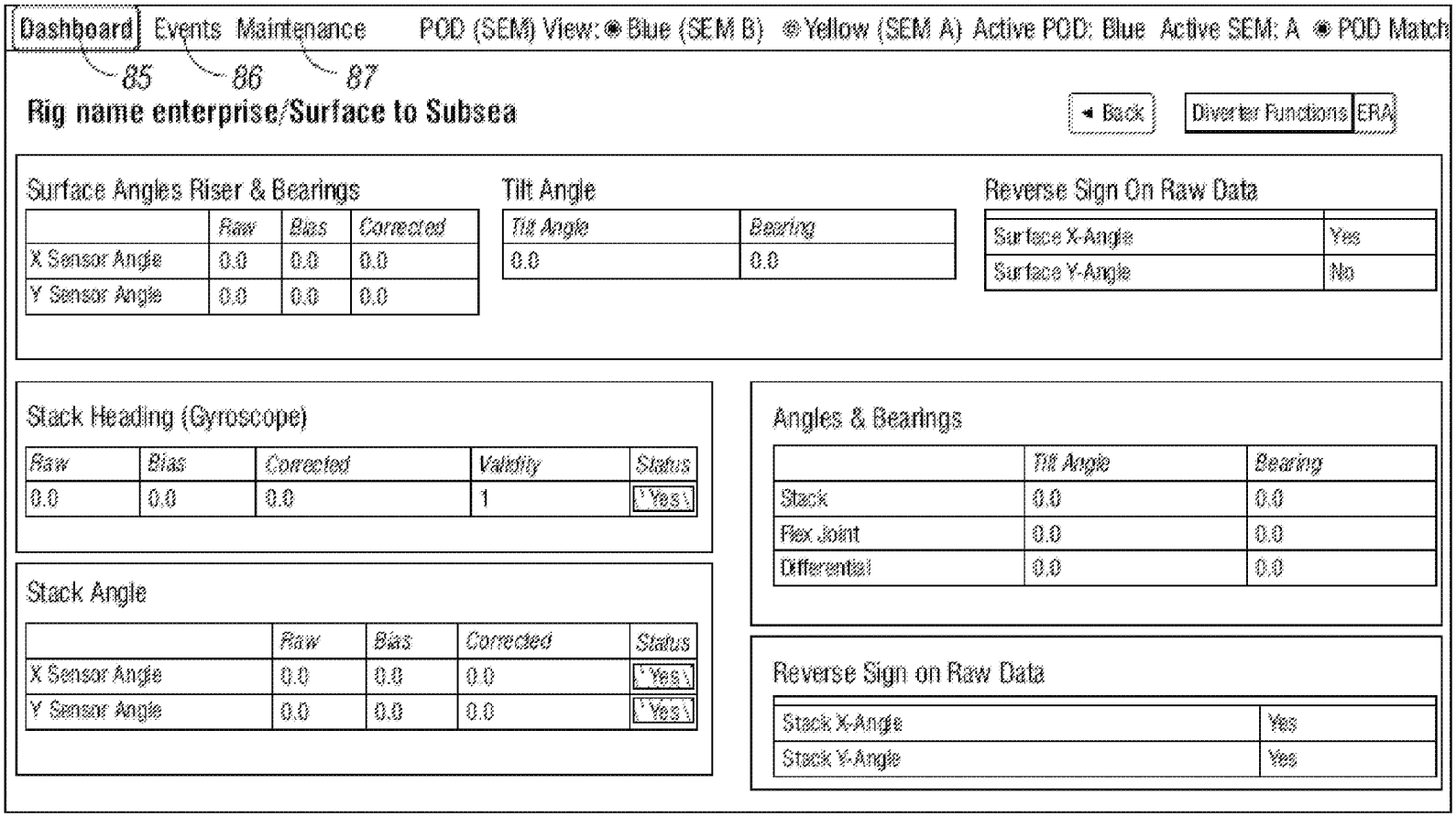

FIGS. 9 & 10 illustrate exemplary surface-to-subsea pages. These pages can be divided into two sections: diverter functions (FIG. 9) and electric riser angles (ERA) (FIG. 10). The diverter function section (FIG. 9) can provide details on all diverter-related functions. The ERA section (FIG. 10) can provide details regarding riser angles and bearings as well as information regarding stack angles and headings.

Figure 11:
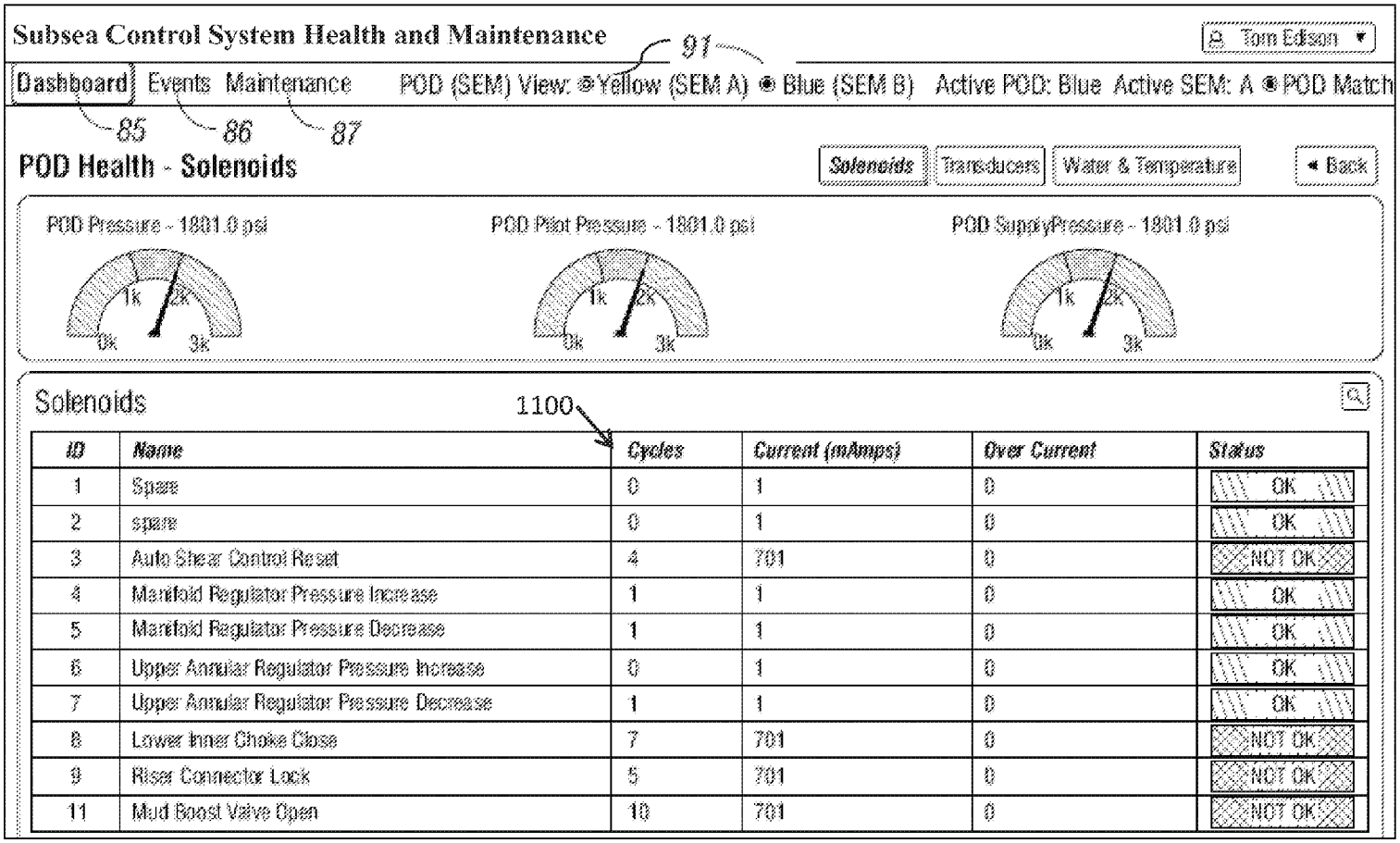
FIG. 11 is an illustration of a pod health details section of a webpage according to an embodiment of the present invention.

FIG. 11 illustrates an exemplary pod health details section. This section can provide information about all the solenoids, transducers, and water and temperature diagnostics in the pod(s). This section also can allow a user to switch the pod view from, for example, blue to yellow to view data from both the pods using a toggle 91 in the navigation bar. This section can be divided into three tabs: one each for solenoids, transducers, and water & temperature. The "Solenoids" tab shown in the figure provides details on all (e.g. 96) solenoids for each pod according to an exemplary pod configuration. The "Transducers" tab provides details on all (e.g. 20) transducers for each pod according to an exemplary pod configuration. The "Water & Temperature Diagnostics" tab can detail all water and temperature diagnostics.

FIG. 12 illustrates an exemplary ram block details section. This section provides details on the real-time positioning of ram blocks disposed within a BOP and related information. For example, the ram block details section can provide data representing the amount of hydraulic pressure required to open or close specified rams.

Referring to FIGS. 13-17 and Appendix 1, according to an exemplary configuration, the health definition of the various subsystems can be determined using graphical flow diagrams/algorithms (FIGS. 13-17) and non-graphical logical flow analysis/algorithms (Appendix 1). These algorithms can provide the background functions for the dashboard pages in tabs. For example, these algorithms can provide traffic light color indicators or numerical values describing the health of components on the stack, such as, for example, annulars, connectors, rams, locks, and regulators. The component health for annulars/connectors and the health of sub-systems, such as, for example, power, communications, hydraulics, surface-to-subsea, pod, and ram blocks, can be provided. It will be understood that these diagrams and algorithms are used according to one or more embodiments of the invention, and other diagrams and algorithms are within the scope of the invention and encompassed by other embodiments.

Figure 13:
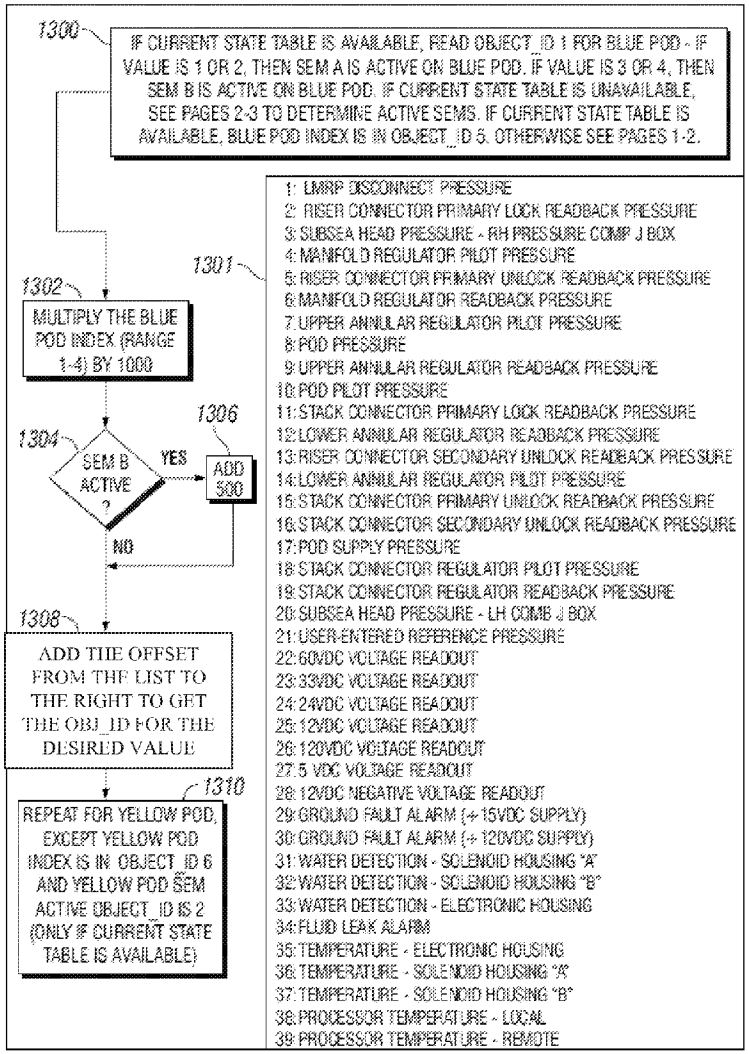
FIGS. 13-17 are flow diagrams illustrating the health definition of various subsystems according to an embodiment of the present invention.

For example, the algorithm provided in FIG. 13 can determine component health for control pods and provide data on pod transducers, voltages, and water and temperature. Starting, without loss of generality, with the blue pod, a current activity state for the pod is first provided and a pod index is provided responsive to this activity state 1300. Next, a multiplier is assigned to the blue pod's index 1302 according to the program product's internal logic. At step 1304, it is determined whether a pod's associated subsea electronics module is active. If so, an addend (e.g., 500) is added to the blue pod's index 1306. Then, the index is offset 1308 by a value taken from a predefined pod health parameter list 1301. The algorithm can be repeated for the yellow pod if a current state table is available for the yellow pod 1310.

Figure 14:
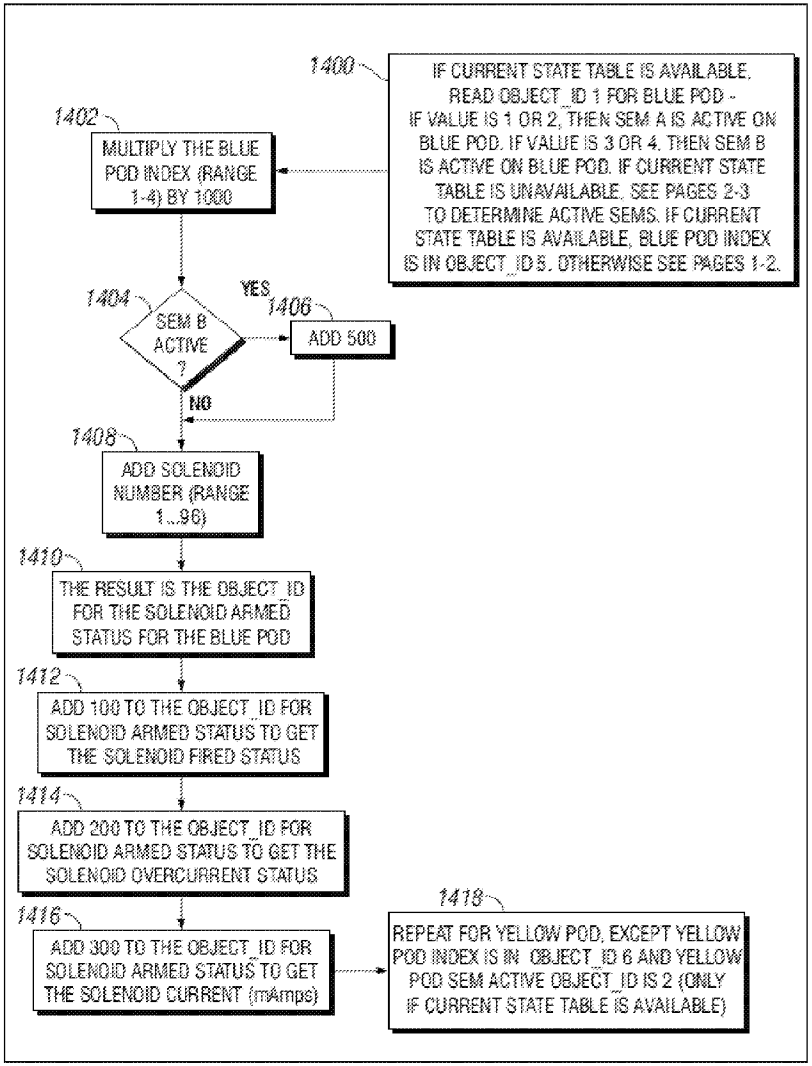

According to an embodiment of the invention, an algorithm provided in FIG. 14 can be used to calculated solenoid parameters, including whether a solenoid is armed or fired. The algorithm further can detect a solenoid's current and detect an overcurrent. Again, an index is first provided if a current state table available for the blue pod 1400. A multiplier is then applied to the index according to the program's internal logic 1402. Next, it is determined whether an SEM is active 1404. If it is, a number, for example 500, is added to the index in step 1406. If the SEM is not active, or if it is active and step 1406 has been completed, a solenoid number is added to the index 1408, thereby to associate the index with a particular solenoid. In subsequent steps, a solenoid armed status is determined 1410, and a solenoid fired status is determined 1412 based on the solenoid armed status. From the solenoid fired status, a solenoid overcurrent status can be derived 1414. In addition, the solenoid current can be determined 1416. The algorithm can be repeated for the yellow pod if the current state table is available 1418.

Figure 15:
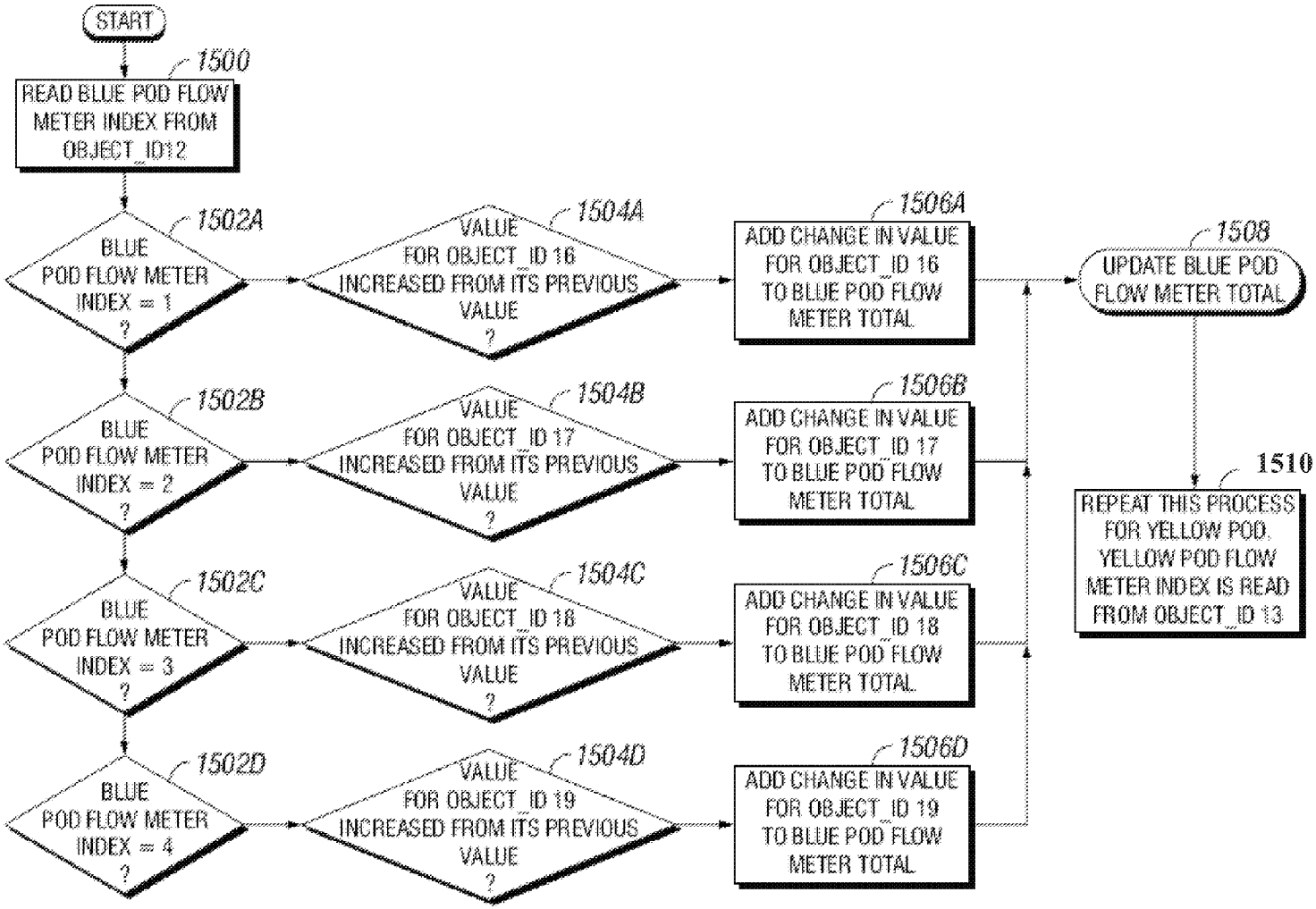

FIG. 15 provides an algorithm to generate subsea flow meter data for display according to an embodiment of the invention. The algorithm can be used if the current state table is available. Flow meter values are resettable totals that will not maintain consistent values. Accordingly, the value displayed can change responsive to consistent monitoring of flow meter data and recalculation of flow meter values, wherein any changes are added to the integrated flow meter value, and the integrated flow meter value can be displayed to a user on one or more displays. According to the algorithm, a blue pod flow meter value is first assigned if available 1500. In an embodiment, the value is assigned from a range of 1-4, each represented at stops 1502A, 1502B, 1502C, and 1502D respectively. A determination is made whether the flow meter value has changed 1504A, 1504B, 1504C, 1504D. Any change in value is then added to the blue pod flow meter total 1506A, 1506B, 1506C, 1506D. The blue pod flow meter value is then updated with the change 1508, and the process is repeated for the yellow pod 1510.

Figure 16:
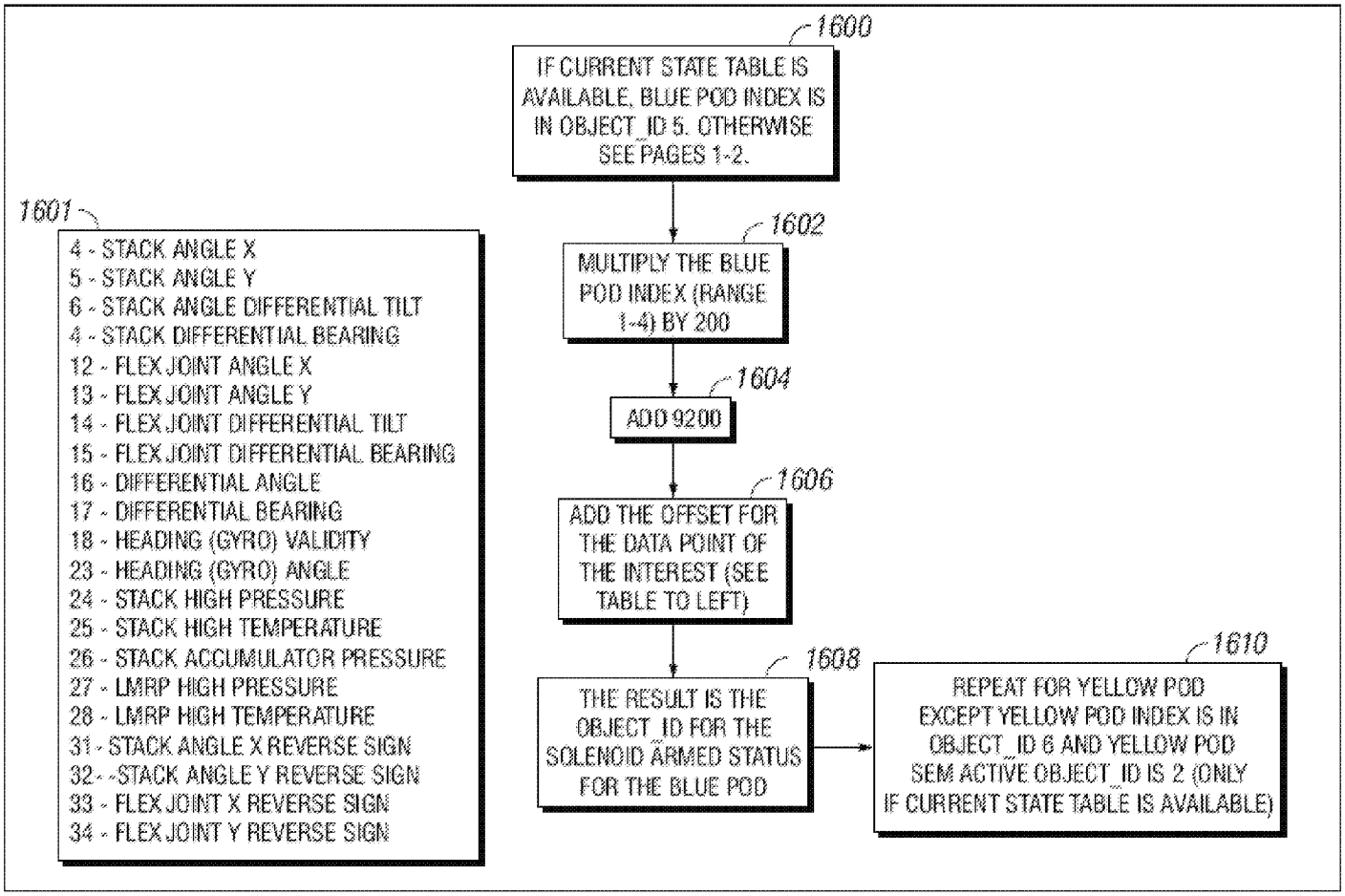

FIG. 16 provides an algorithm to generate data relating to pod electric riser angles (ERA), headings derived from gyroscope indications, and high-pressure-high-temperature indications. A blue pod index is first assigned 1600 according to an embodiment of the invention. A multiplier is then applied according to the program's internal logic 1602. An addend is then added (for example, 9200 in the illustrated embodiment) 1604 and an offset is added 1606 to the new total. The offset can be an offset taken from a predefined BOP angle, temperature, and pressure data list 1601. The updated index provides a solenoid armed status for the blue pod 1608, and the process can be repeated for the yellow pod 1610.

Figure 17:
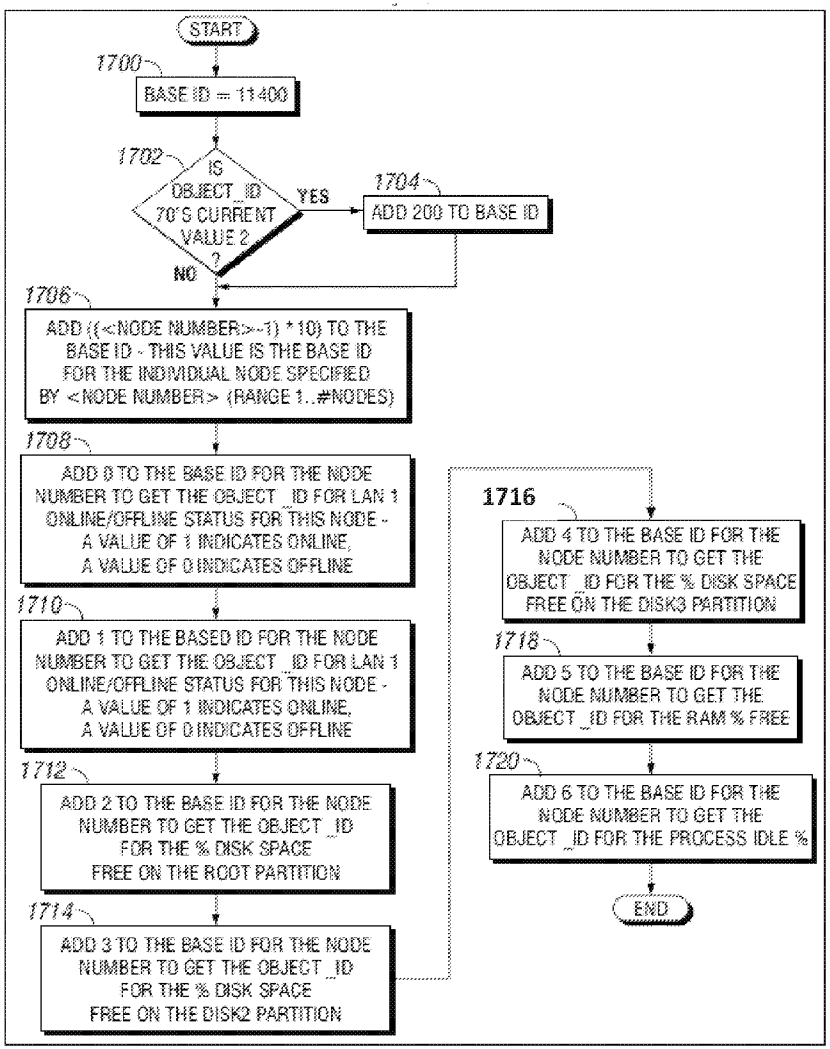

FIG. 17 provides an algorithm to determine network topology according to an embodiment of the invention. In embodiments, data can be provided on the status of the Local Area Network, disk space, and processor utilization, for example. In an embodiment, a base ID (for example, 11400 in the illustrated embodiment) is provided 1700. According to the program's internal logic, a value can be added to the base 1702, 1704. Further, the base ID can be modified to provide a base ID for an individual specified node 1706. An online or offline status can then be determined for a particular node 1708, 1710. Adding, for example, 2 to the base ID can provide the percentage of disk space free on the root partition 1712. The algorithm can further determine the percentage of disk space free on defined disk partitions of a hard disk drive 1714, 1716. In subsequent steps, the algorithm can determine the percentage of RAM free 1718 and the process idle percentage 1720.

Figure 18:
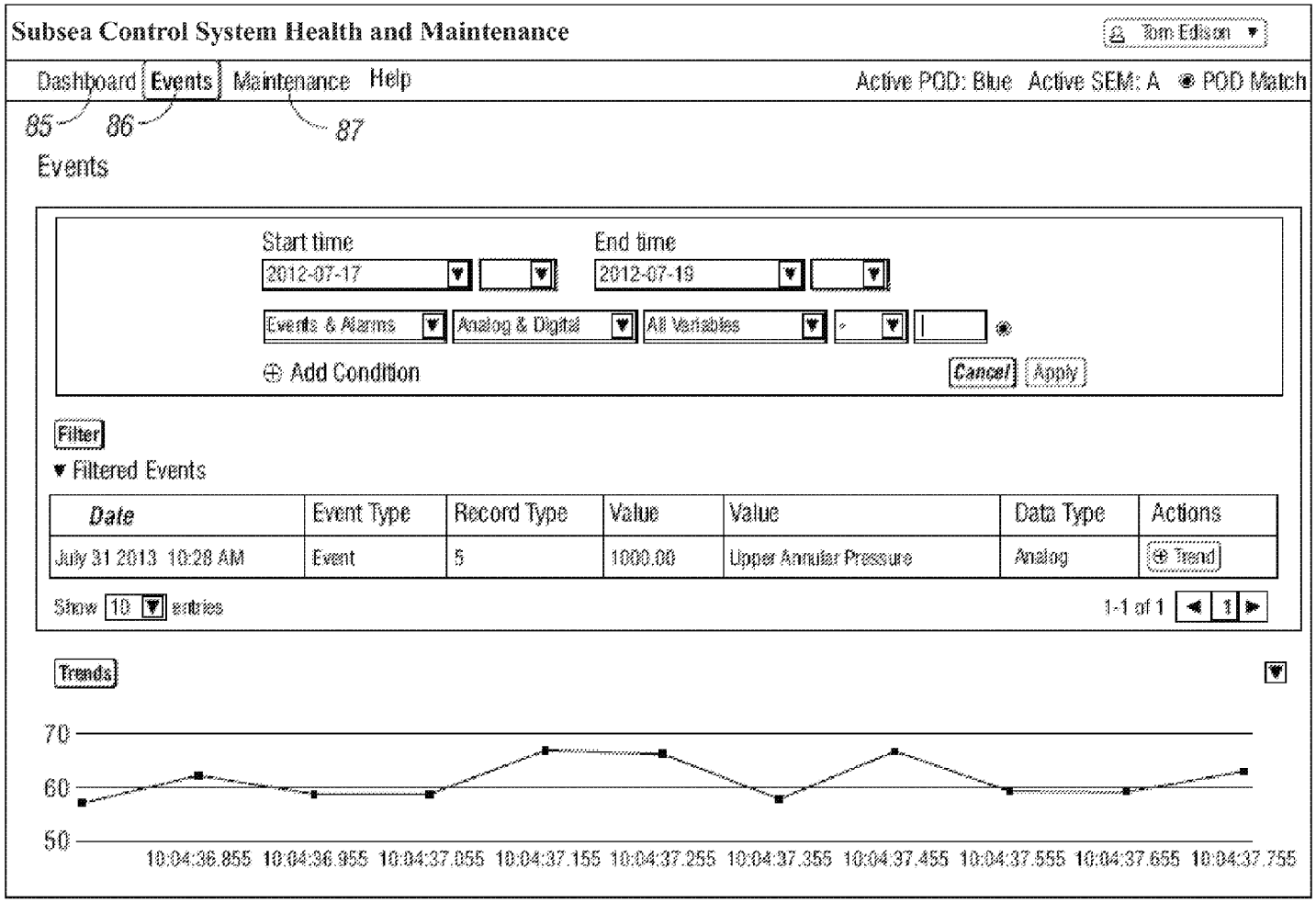
FIG. 18 is an illustration of an events webpage according to an embodiment of the present invention.

FIG. 18 illustrates an exemplary events page, which provides a graphical user interface with an events program module (not shown) interfaced through text fields, drop-down menus, buttons, and display graphics. The events module allows drilling contractors and other users to access BOP data offshore or onshore for faster troubleshooting. The events module can allow a user to enter values to allow a user to filter (search) datalogger 72 data based, for example, on time (e.g., start time and end time of an event or alarm), type (e.g., an event or alarm), pod (e.g., blue or yellow), and/or SEM (e.g., A or B). The events module also can provide the ability to further filter the result set based on keywords (e.g., free-form search), to trend a specific event, to view multiple trends for troubleshooting purposes, to export trends to PDF or CSV format, among others, and to provide server side pagination.

Figure 19:
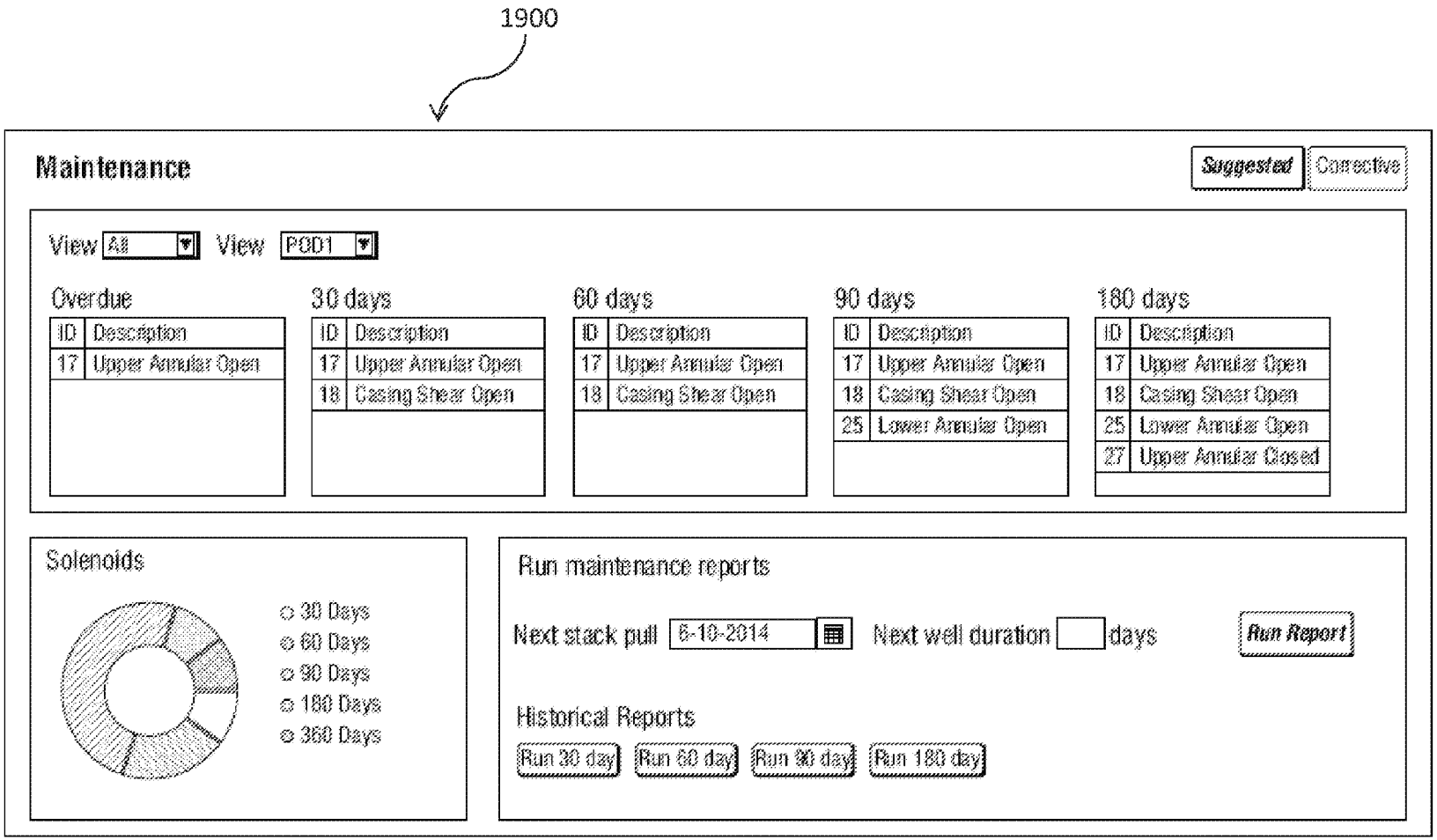
FIG. 19 is an illustration of a maintenance webpage according to an embodiment of the present invention.

FIG. 19 illustrates an exemplary maintenance page that provides a graphical user interface to a maintenance module 1900, which can provide integration with customer's enterprise resource planning (ERP), chain of components analysis based on the firing count of solenoids whereby the cycle counts of downchain BOP components in a hydraulic circuit could be derived. These downchain BOP components can include solenoid valves 64, 64', 64" and associated solenoids 66, 66', 66", shear seal valves 2400, 2400' configured to seal a wellbore occupied by a drill string by shearing through the drill string to close off the wellbore, sub-plate mounted (SPM) valves 2402, 2402', MPL components 2406 configured to provide for valve positions between fully open and fully closed thereby to control the amount of fluid that can pass through the BOP, flow meters 2604 configured to measure the flow of fluid through the BOP, high-pressure and high-temperature probes 2608 configured to provide BOP internal temperature and pressure data, transducers 2606 configured to provide data on additional physical parameters, ram packers 2408, packing units 2500, shuttle valves 2404, 2404' configured to allow fluid flow to take an alternative channel responsive to fluid pressure as known by those of skill in the art, and regulators 2610. For example, for ram BOPs, these downchain BOP components can include shear seal valves 2400, SPM valves 2402, shuttle valves 2404, MPL components 2406, and/or ram packers 2408. This is illustrated schematically in FIG. 24. For annular BOPs, these downchain BOP components can include shear seal valves 2400', SPM valves 2402', shuttle valves 2404', and/or packing units 2500. This is illustrated schematically in FIG. 25. According to an exemplary embodiment, the derived cycle count of the respective components can be used to recommend replacement intervals for each component.

The maintenance module 1900 can provide visibility into the health of major components and needs for corrective replacement. The maintenance module 1900 further can provide filtering capabilities of major components, input and storage of suggested/corrective maintenance data, a dashboard of overdue components and timeline for replacement, and report generation of "suggested" components that need replacement. This maintenance advice is based on a threshold defined by a user for each solenoid function. For example, as shown in FIG. 19, suggested maintenance/component replacement advice can be given to the user based on a replacement algorithm which suggests replacing components in the next 30/60/90/180 days or based on whether a particular component is overdue.

Figure 20:
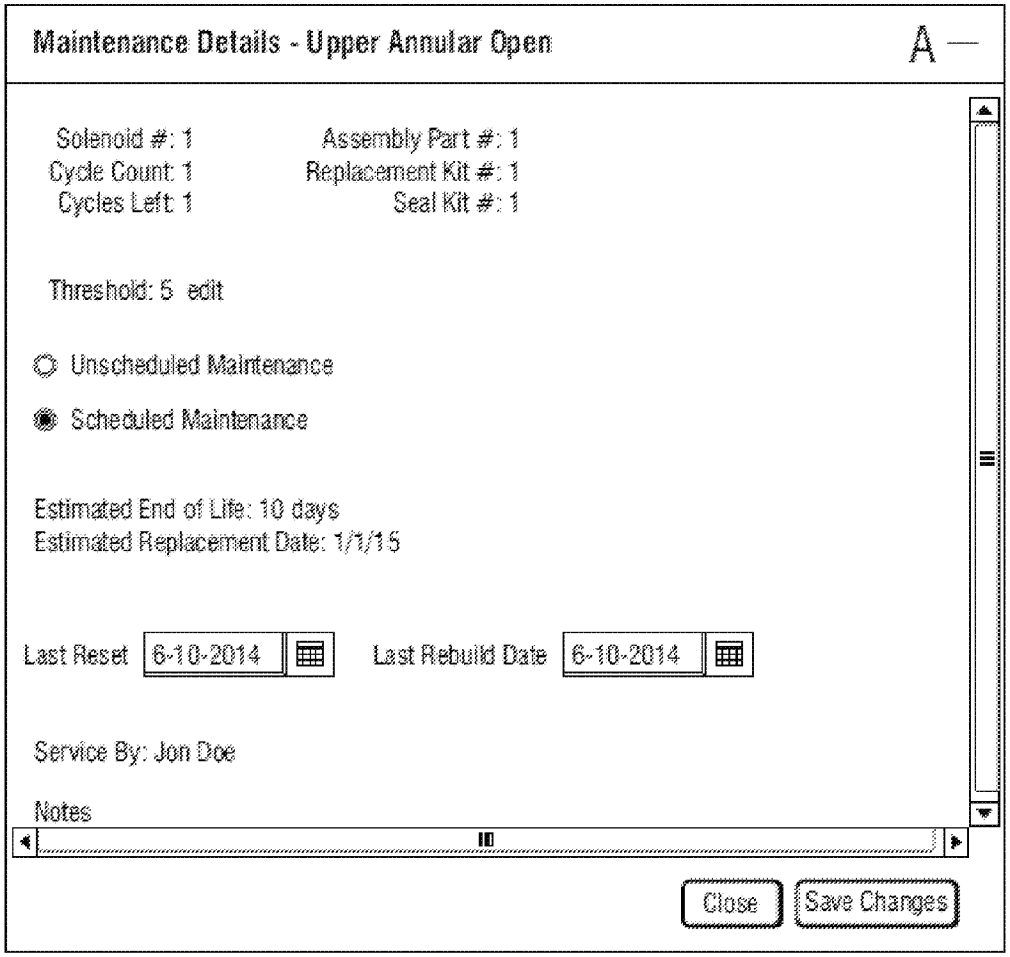
FIG. 20 is an illustration of a portion of a maintenance details webpage according to an embodiment of the present invention.

Still referring to FIG. 19, and additionally to FIG. 20, when a user clicks on individual components in each of the sections shown in FIG. 19, the maintenance details graphic (FIG. 20) can be presented to allow the user to reset the replacement/rebuild dates or thresholds and also to specify if the maintenance was scheduled or unscheduled.

FIG. 21 illustrates a maintenance report page 2102 that provides a graphical user interface to a maintenance report module, which can provide information related to future component replacement, historical maintenance reports, and management reports. This information can include high level parameters, regulatory reports, and Factory Acceptance Test (FAT) reports. A customer can view reports generated in an electronic format from the data captured in the datalogger.

The maintenance report page 2102 can allow the user to run a report based on the next stack pull and the well duration. This essentially can provide the user a list of all the components that are due for preventive maintenance or replacement during the next stack pull and during the well duration period in order to better prepare for scheduled maintenance. The maintenance report page 2102 can also allow a user to view pre-defined historical reports, which provide an end user a list of all the components that were replaced in the last, for example, 30/60/90/180 days.

Figure 22:
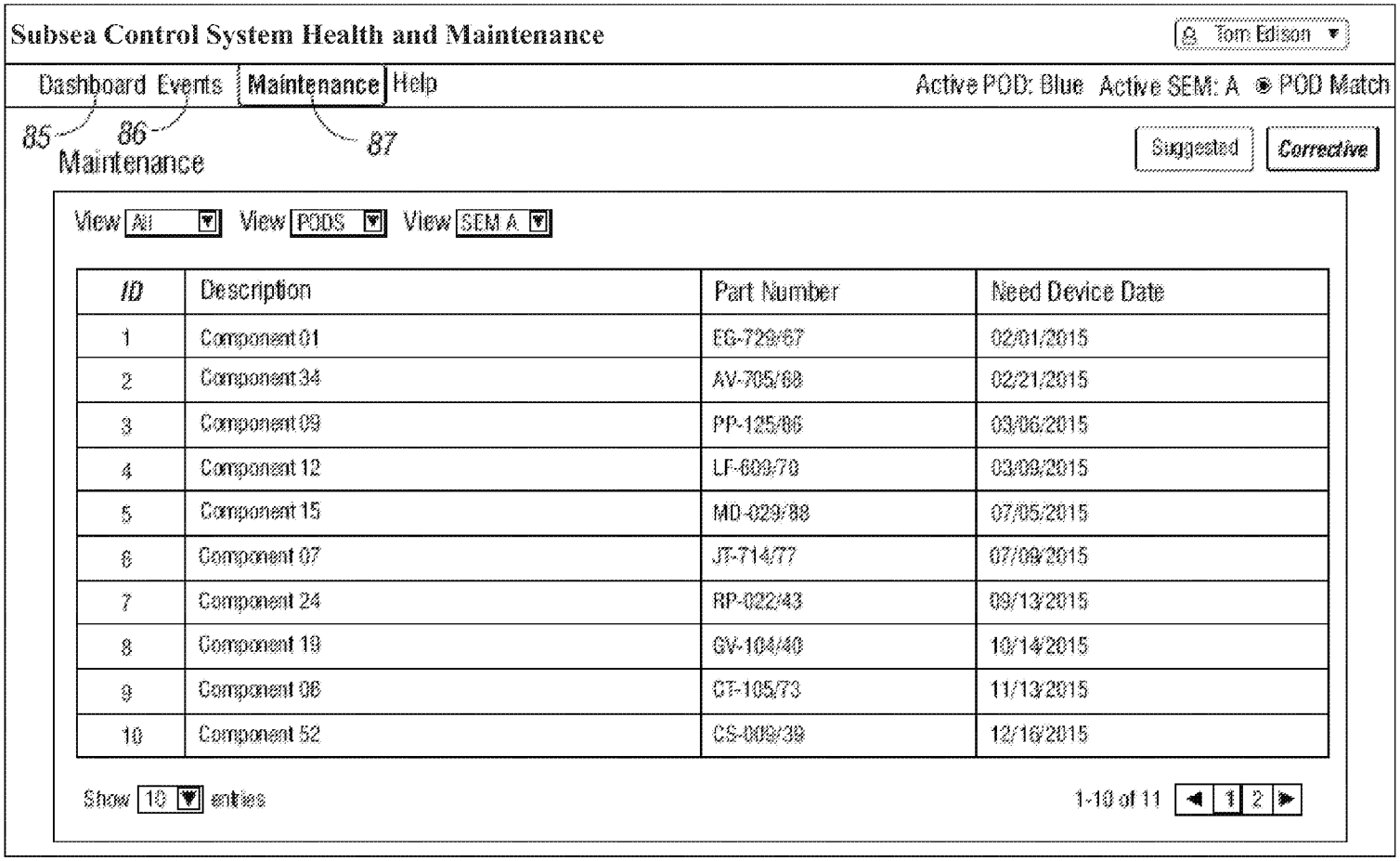
FIG. 22 is an illustration of a corrective maintenance tab according to an embodiment of the present invention.

FIG. 22 illustrates a corrective maintenance page 87. The corrective maintenance tab can allow a user to store information relating to any component that may be a candidate for maintenance besides the suggested components.

Figure 23:
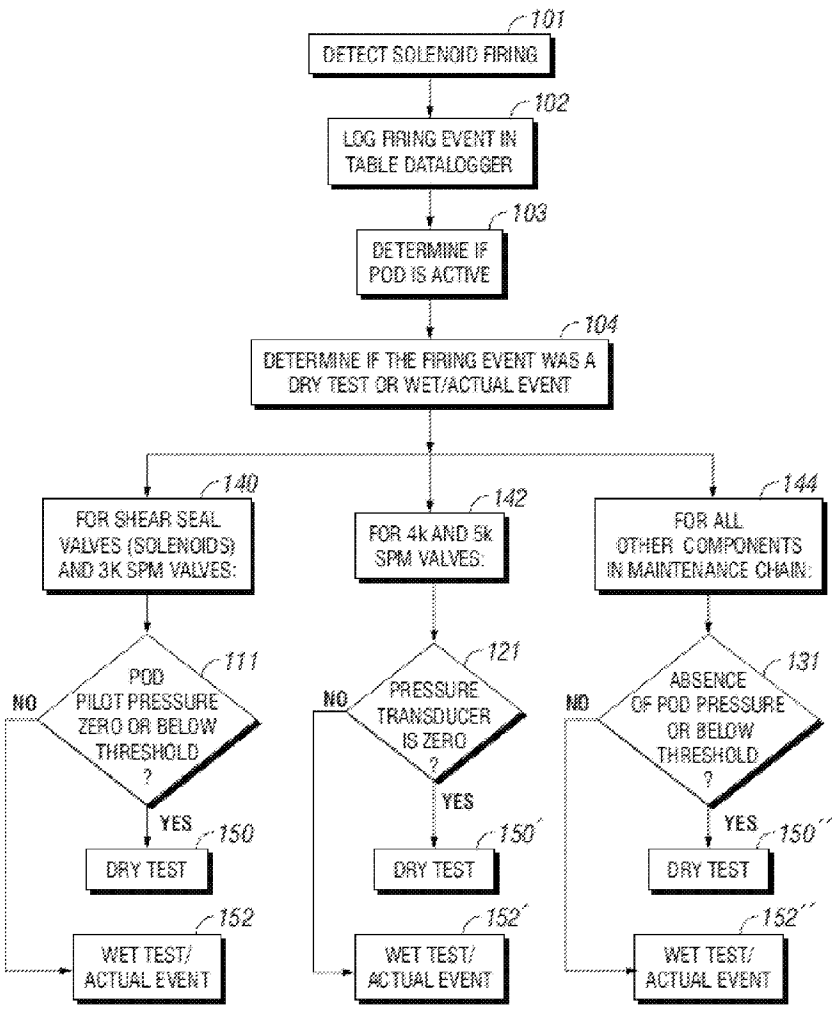
FIG. 23 illustrates a flow diagram for identifying and storing log firing events, pod, active/inactive status, and whether or not a dry test or wet test/actual event has occurred according to an embodiment of the present invention.

FIG. 23 illustrates a flow diagram for identifying and storing log firing events, pod, active/inactive status, and whether or not a dry test or wet test/actual event has occurred. This information can provide criteria for determining whether to increment a cycle count for a particular hydraulic component in a respective component chain. At step 101, a solenoid firing is detected, and at step 102 the firing event is logged in a table by a datalogger. At step 103, it is determined whether or not the respective associated pod is an active or non-active pod.

At step 104, it is determined if the firing event was a dry test or wet/actual event. In embodiments, the determination criteria can be dependent upon whether or not the hydraulic component in the chain is a shear valve or an SPM valve pressurized with a predefined first pressure, such as 3000 psi, an SPM valve pressurized at a predefined second pressure higher than the first pressure, such as 4000 or 5000 psi, or some other type of component in the maintenance chain. For shear seal valves and SPM valves at the predefined first pressure, for example 3000 psi 140, if the pod pilot pressure is zero or below a threshold as indicated at step 111, the test is a dry test 150; otherwise, it is considered a wet test or actual event 152. For SPM valves at the predefined second pressure, for example 4000 and 5000 psi SPM valves 142, if the pressure transducer 68 is zero as indicated at step 121, the test is a dry test 150'; otherwise, it is considered a wet test or actual event 152'. For all other downchain BOP components in the maintenance chain 144, if there is no pod pressure or the pod pressure is below a threshold as indicated at step 131, the test is a dry test 150"; otherwise, it is considered a wet test or actual event 152".

Beneficially, the wet/dry testing analysis, similar to the chain of components analysis above, can allow the end user to distinguish which components were fired if the testing was done subsea (wet) or if the testing was done on the surface (dry). This solution provides for distinguishing between a wet or dry test based on flow meter and/or pod pressure.

For wet testing, a solenoid firing event is captured and pod pressure is verified to he in a certain range or minimum/maximum value, or, alternatively, a flowmeter value change is registered to determine if the test was wet. If the test is a wet test, the components described above in the hydraulic chain have their count incremented based on the solenoid cycle count and a recommended replacement interval is derived. For dry testing, a solenoid firing event is captured and the absence of pod pressure, or, alternatively, a lack of change in the flowmeter value is registered to determine if the test is dry. If the test is a dry test, only the components on the pod (e.g., shear seal valves, SPM valves) have their cycle counts incremented.

The test distinguishes between active 2600 and non-active pods 2602. That is, the cycle counts 1100 of components on the active pod 2600 are different in comparison to the components on the non-active pod 2602 based on the chain of events described above. For example, for the active pod 2600, the cycle count 1100 will increment for every component starting from solenoids 66 to the ram packer 2408 or annular packing unit 2500, but, for the non-active pod 2602, the cycle count 1100 will be incremented for a subset of downchain BOP components starting with the solenoids 66 but stopping at SPM valves 2402. The derived cycle count 1100 then is used to recommend replacement intervals for each component.

Analytics, as would be understood by those of ordinary skill in the art, can be used to enhance identification of the number of cycles which dictate when a part should be inspected and/or replaced. The analytics can include, smart signals integration and predictive analytics based on operational data, similar to pattern recognition. For example, a projected replacement date 2100 can be extrapolated from average historical usage of a component to determine when a component will reach a predetermined cycle count. The determination also can factor in anticipated future usage, which can be based on the time of year or the type of activity being performed on the well. In addition, a projected replacement date 2100 can be determined using a combination of two or more of these factors.

In embodiments, a user receives automatic alerts under certain circumstances. For example the automatic alerts can relate to and be sent responsive to the cycle count of the solenoid or any of the downchain BOP components. The automatic alerts can be configured to be sent a user when a cycle count reaches a predefined threshold, when a cycle count comes within a certain number of a predefined threshold, when the system determines that a solenoid 66 or a downchain BOP component must be replaced, or when the system determines that the solenoid or a downchain BOP component must be replaced within a predefined number of days. For example, an automatic alert can be sent to the user when system determines the SPM valve must be replaced in 50 cycles. As another example, an automatic alert can be sent to the user on the one or more displays when the system determines the ram packer is due to be replaced or should be replaced in 30 days.

In embodiments, the automatic alerts can relate to and be sent responsive to a parameter associated with one or more of the plurality of downchain BOP components. For example, an automatic alert can be sent responsive to a solenoid overcurrent or undercurrent if the current respectively exceeds or drops below a predefined value. The automatic alert also can be sent responsive to fluctuations in the solenoid current if fluctuations in the solenoid current exceed a predefined value. In embodiments, the automatic alert can be sent if pressure in the regulators exceeds a predefined value, which could be set at, for example, 1600 psi. In addition, automatic alerts can be sent if any of the system's transducers or other components behave abnormally. It will be understood by one of ordinary skill in the art that the foregoing functions can be carried out by a plurality of dedicated modules initiated by one or more processors upon execution of a set of instructions stored in a tangible computer-readable medium.

Figure 24:
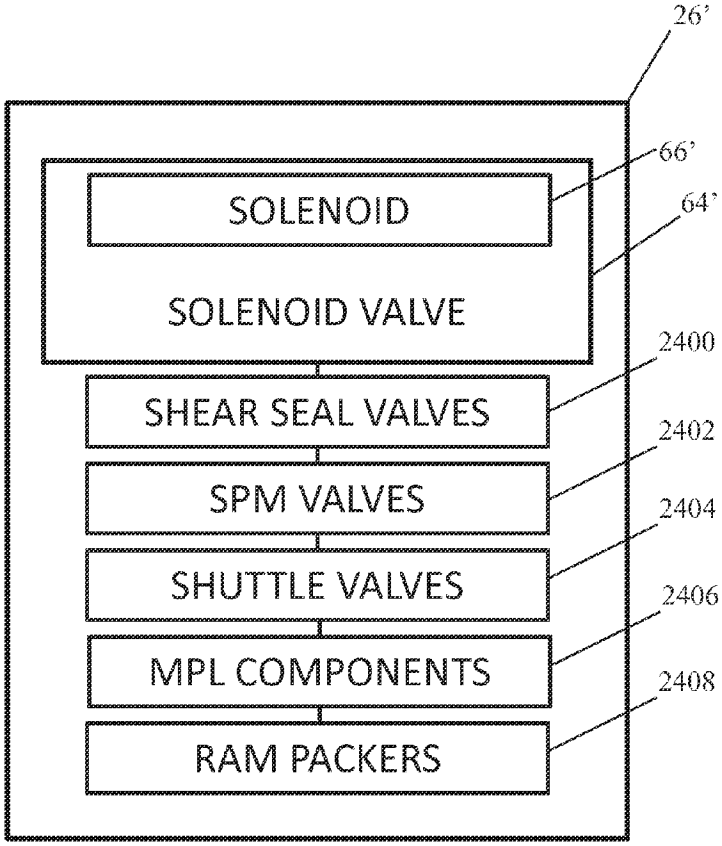
FIG. 24 is a schematic illustration of a blowout preventer including a solenoid valve and a number of downchain BOP components according to an embodiment of the invention.

FIG. 24 provides a schematic of a blowout preventer 26' according to an embodiment of the invention. A solenoid valve 64' and associated solenoid 66' disposed within are shown. A plurality of downchain BOP components also are illustrated. For example, in an exemplary BOP configuration, downchain BOP components can include shear seal valves 2400, SPM valves 2402, shuttle valves 2404, MPL components 2406, and ram packers 2408. A schematic is provided as many configurations of these components within a BOP are within the skill of the art.

Figure 25:
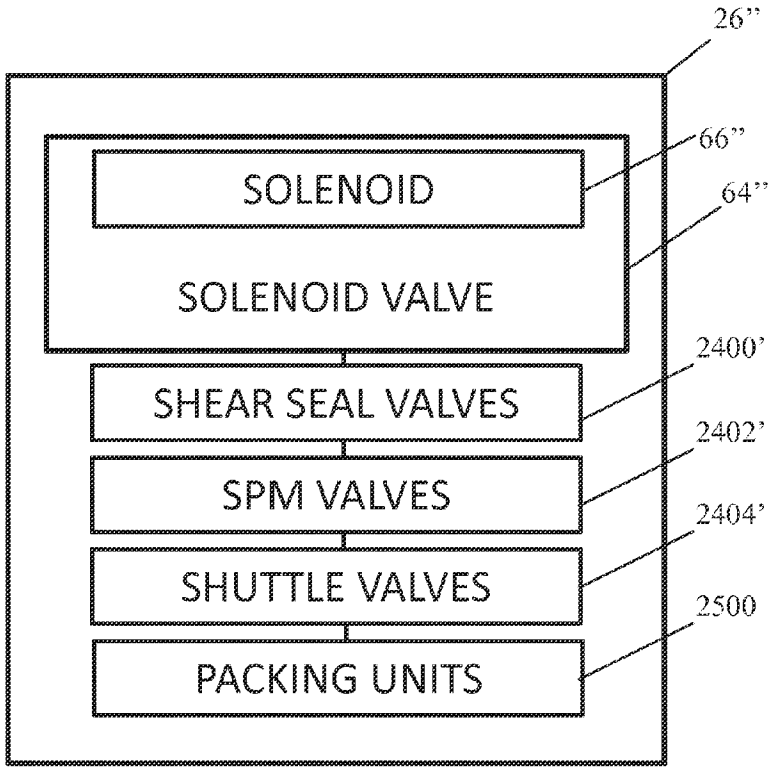
FIG. 25 is a schematic illustration of a blowout preventer including a solenoid valve and a number of downchain BOP components according to an embodiment of the invention.

FIG. 25 provides another schematic of a blowout preventer 26" according to another embodiment of the invention. A solenoid valve 64" and associated solenoid 66" disposed within are shown. A plurality of downchain BOP components also are illustrated. For example, in an exemplary BOP configuration, downchain BOP components can include shear seal valves 2400', SPM valves 2402', shuttle valves 2404', and packing units 2500. A schematic is provided as many configurations of these components within a BOP are within the skill of the art.

Figure 26:
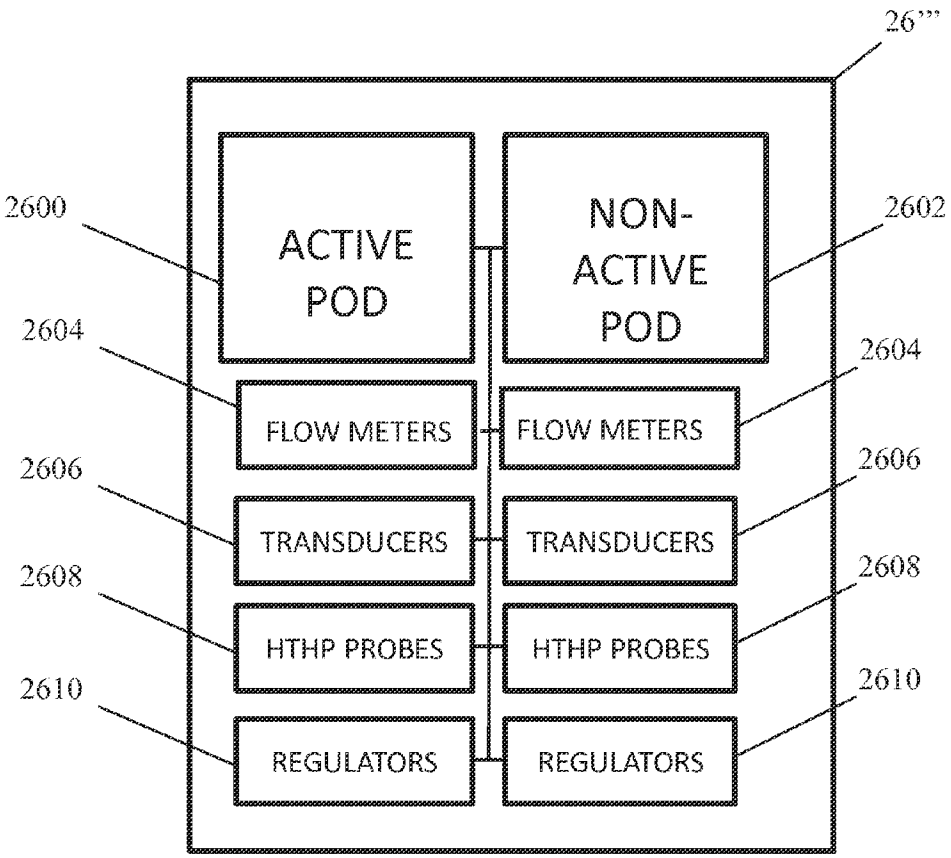
FIG. 26 is a schematic illustration of a blowout preventer including an active and non-active control pod and various additional downchain BOP components according to an embodiment of the invention.

FIG. 26 provides another schematic of a blowout preventer 26''' according to an embodiment of the invention. A pair of control pods 2600, 2602 are shown, including an active pod 2600 and a non-active pod 2602. A plurality of downchain BOP components also are illustrated associated the pair of control pods 2400, 2602. For example, in an exemplary BOP configuration, downchain BOP components can include flow meters 2604, various transducers 2606 in addition to the pressure transducers 68 illustrated in FIG. 3, high-temperature-high-pressure (HTHP) probes 2408, and regulators 2610. A schematic is provided as many configurations of these components within a BOP are within the skill of the art. It is stressed that such a configuration is merely illustrative and designed to demonstrate to the reader that each pod is associated with a set of components. It will be understood by one of skill in the art that in certain embodiments many, if not all, components associated with one pod can be associated with the other pod as well.

The present application is a non-provisional application which claims priority to and the benefit of U.S. Provisional Application No. 61/923,076, filed on Jan. 2, 2014 and titled "Systems, Computer Programs, and Methods of Providing Data Visualization for Health Monitoring and Preventive Maintenance Decision-Making for Subsea Control Subsystem Components" the disclosure of which is incorporated herein in its entirety.

In the drawings and specification, there have been disclosed a typical preferred embodiment of the invention, and, although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification.

Appendix 1

Surface Power Health Logic

```
If the Blue UPS is Health and the Yellow UPS is Healthy, perform the
following:
  If the Blue CCU, Yellow CCU, Diverter, HPU, and Drillers Panel are
all
  Healthy,
perform the following:
    If the Blue PDP and the Yellow PDP are both health (see below)
      Surface Power Health is OK (Green)
    Else
      Surface Power Health is Not OK (Orange)
  Else
    Surface Power Health is Not OK (Orange)
Else
  Surface Power Health is Not OK (Orange
```

UPS Health Logic:

```
Perform the following separately for the Blue UPS and the Yellow UPS:
If Inverter is OFF or if the Static Switch is Not Normal
  UPS Health is Not OK (Orange)
Else
  If at least 1 of the following conditions is true:
  Outrun Short Circuit
  Inverter Shutdown - Fuse/Over Temp
  Inverter Shutdown - Low Output Voltage
  Inverter Shutdown - Bypass Breaker On
  Inverter Shutdown - DC Over Voltage
  Inverter Shutdown - Overload
  Load 110%
  Load 125%
  Load 150%
  Reserve Shutdown - voltage Out of Range
  Reserve Shutdown - Frequency Out of Range
  Battery Low - Inverter Shutdown Imminent
  Battery Low - Inverter Shutdown
  Rectifier Shutdown - Voltage Out of Range
  Phase Rotation Error
  Rectifier Shutdown - DC Over Voltage
  DC Over Voltage
  Emergency Stop Activated
    UPS Health is Not OK (Orange)
  Else
    UPS Health is OK (Green)
```

PDP/Cabinet Health:

```
If Blue CCU 24 VDC Power Flags are True and the Blue CCU 120 VAC Power Flags are True
and the Blue CCU Line Fault is False
  Blue CCU Power Health is OK (Green)
If Yellow CCU 24 VDC Power Flags are True and the Yellow CCU 120 VAC Power Flags are
True and the Yellow CCU Line Fault is False
  Yellow CCU Power Health is OK (Green)
If the Diverter 24 VDC Power Flags are True and the Diverter 120 VAC Power Flags are True
  Diverter Power Health is OK (Green)
If the HPU 24 VDC Power Flags are True and the HPU 120 VAC Power Flags are True
  HPU Power Health is OK (Green)
If the Driller's Panel 24 VDC Power Flags are True and the Driller's Panel 120 VAC Power Flags
are True
```

-continued

Driller's Panel Power trealth is OK (Green)
If the Blue PDP Ground Fault is False and the Blue Subsea Transformer (Xfmr) Ground Fault, is False
Blue PDP Health is OK (Green)
If the Yellow PDP Ground Fault is False and the Yellow Subsea Transformer (Xfmr) Ground Fault is False
Yellow PDP Health is OK (Green)

Surface Communications Health:

If All Nodes Online (obj_id value = 0 is Online, 1 = offline)
If All Network Topology IDs are within alarm limits for all nodes on both system
controllers
If All Processes for all nodes are online (primary and secondary)
Surface Comms are Healthy (Green)
Else
Surface Comms are Unhealthy (Orange)
Else
Surface Comms are Unhealthy (Orange)

-continued

Else
Surface Comms are Unhealthy (Orange)

Default Alarm Limits for Network Topology IDs:

Network Online: 0 = offline (Not OK), 1 = online (OK)
Root Partition %: value <= 5 is Not OK, anything > 5 is OK
disk2 Partition %: value <= 5 is Not OK, anything > 5 is OK
disk3 Partition %: value <= 5 is Not OK, anything > 5 is OK
RAM Free %: value <= 10 is Not OK, anything > 10 is OK
Processor Utilization %: value <= 10 is Not OK, anything > 10 is OK

Process Online Values:

System Controller Program: If value is 1 or 2, process is Online (applies to both primary and secondary); if value is 0, process is Offline
Alarm Manager Program: If value is 1 or 2, process is Online (applies to both primary and secondary); if value is 0, process is Offline
History Manager Program: If value is 1 or 2, process is Online (applies to both primary and secondary); if value is 0, process is Offline
System Configuration Program: If value is 1 or 2, process is Online (applies to both primary and secondary); if value is 0, process is Offline
Pod Controller (All - applies to Blue SEM A, Blue SEM B, Yellow SEM A, Yellow SEM B): if value is 4 or 5, process is Online; if 0, process Offline.
UPS Software Program (Applies to Blue and Yellow): If value is 3 or 6, process is Online; if value is 0, process is Offline
Surface Riser ERA Program: If value is 3 or 6, process is Online; if value is 0, process is Offline
SatNav Program: If value is 3 or 6, process is Online; if value is 0, process is Offline
Message Controller Software Program Node 1: If value is 1, process is Online, if value is 0, process is Offline
Message Controller Software Program Node 2: If value is 2, process is Online, if value is 0, process is Offline
Blue ASK Software Program: If value is 4, process is Online, if value is 0, process is Offline
Yellow ASK Software Program: If value is 5, process is Online, if value is 0, process is Offline

Subsea Power Health:

If Pod Power is On (obj_id 7001 for Blue Pod, and 8001 for Yellow Pod - a value of 1 is On, 0 is Off)
If Blue Subsea Transformer Ground Fault (obj_id 7014) False And Yellow Subsea Transformer Ground Fault (obj_id 8014) False
If all voltage readbacks within alarm hi and low limits (See Pod Sensors flowchart (FIG. 12) - the voltage obj_ids to cheek are 22-30 in the table on that page. Default limits are +/− 10%; If there are updates to these limits in the Alarms tables, these values supercede the default limits)
Subsea Power is OK (Green)
Else
Subsea Power Is Not OK (Orange)
Else
Subsea Power is Not OK (Orange)
Else
Subsea Power is Not OK (Orange)

Subsea Function Health (Coincides with FIG. 14)

```
If Pod Comms are OK // see Pod Comms pseudocode
  If 60 VDC and 33VDC for Active SEM on the Active Pod are within their respective
  alarm limits
    If the Solenoid current record for all of the solenoids associated with the device
  less than their alarm high limit
      If the Solenoid overcurrent obj_id for all of the solenoids associated with
  the device has a value of 0
        If the Solenoid fire count for all of the solenoids associated with
  the device are less than the specified thteshhold
          Set the function's health status to OK (green)
        else
          Set the function's health status to Not OK (orange)
      else
        Set the function's health status to Not OK (orange)
    else
      Set the function's health status to Not OK (orange)
  else
    Set the function's health status to Not OK (orange)
else
  Set the function's health status to Not OK (orange)
```

Subsea Communications Health (Coincides with FIG. 13)

```
If Blue Pod SEM A is Active and Blue Pod SEM A Primary Comms are Not OK
  Status is Not OK (Orange)
Else If Blue Pod SEM B is Active and SEM Pod SEM B Primary Comms are Not OK
  Status is Not OK (Orange)
Else If Yellow Pod SEM A is Active and Yellow Pod SEM A Primary Comms are Not OK
  Status is Not OK (Orange)
Else If Yellow Pod SEM B is Active and Yellow Pod SEM B Primary Comms are Not OK
  Status is Not OK (Orange)
If None of the above conditions are true
  Subsea Comms are OK (Green)
```

Ram Block Health

Always Green (no alarms for Ram Blocks)

Pod Match Health

```
If obj_id 9 value = 0
  Pod Match is Not OK (Orange)
Else
  Pod Match is OK (Green
```

Pod Health

```
For each Pod (Blue and Yellow)
  If Pod Comms are Not OK (see Pod Comms Health)
    Pod Health is Not OK (Orange)
```

-continued

```
  Else
    For each Subsea Function (see Subsea Function health)
      If the Subsea Function is Not OK
        Pod Health is Not OK (Orange)
    If All Subsea Functions are OK
      For each Subsea Sensor (see FIG. 12 )
        If the sensor value is less than the low alarm limit or greater
        than
  the high alarm limit (see defaults below)
          Pod Health is Not OK (Orange)
        Else
          Pod Health is OK (Green)
Default Alarm Limits are provided as items 01-02, 04-19, and 22-39
(not shown)
```

Pod Communication Pseudocode

```
Determine current Pod Indices and current Active SEMs for both Pods
Check solenoid fired state for solenoid 74 (pod select) for both Pods
if Blue Pod select fired state = 1
  if SEM A active on Blue Pod
    Read obj_id 85
    if value = 4
      read obj_id 114
      if value = 1
        Pod Comms are OK
      else
        Pod Comms are Not OK
    else if value = 5
      read obj_id 214
      if value = 1
        Pod Comms are OK
      else
        Pod Comms are Not OK
```

-continued

```
      else
        Pod Comms are Not OK
    else // SEM B active
      read obj_id 285
      if value = 4
        read obj_id 115
        if value = 1
          Pod Comms are OK
        else
          Pod Comms are Not OK
      else if value = 5
        read obj_id 215
        if value = 1
          Pod Comms are OK
        else
          Pod Comms are Not OK
      else
        Pod Comms are Not OK
else if Yellow Pod select fired state = 1
  if SEM A active on YellowPod
      Read obj_id 87
      if value = 4
        read obj_id 117
        if value = 1
          Pod Comms are OK
        else
          Pod Comms are Not OK
      else if value = 5
        read obj_id 217
        if value = 1
          Pod Comms are OK
        else
          Pod Comms are Not OK
      else
        Pod Comms are Not OK
  else // SEM B active
      read obj_id 287
      if value = 4
        read obj_id 118
        if value = 1
          Pod Comms are OK
        else
          Pod Comms are Not OK
      else if value = 5
        read obj_id 218
        if value = 1
          Pod COMMS are OK
        else
          Pod Comms are Not OK
      else
        Pod Comms are Not OK
else // Pod Blocked
  check Blue Pod comm status (see first If block when Blue Pod Select solenoid is fired)
  check Yellow Pod comm status
  if Blue Pod comm status is OK OR Yellow Pod comm status is OK
      Pod Comms are OK
  else
      Pod Comms are Not OK
```

HPU Hydraulics Health

```
If HPU Low Hydraulic Pressure Alarm is True (obj_id 5018)
  HPU Health is Not OK (Orange)
If the HPU Panel I/F Switch is On (obj_id 5020 value = 1)
  HPU Health is Not OK (Orange)
If Accumulator Pressure is less than the low alarm limit Or Accumulator Pressure is greater
than
  the high alarm limit (default values: low: 3000, high: 4500)
  HPU Health is Not OK (Orange)
If Manifold Pressure is less than the low alarm limit Or Manifold Pressure is greater than the
  high alarm limit (default values: low: 3000, high: 4500)
  HPU Health is Not OK (Orange)
If None of the above conditions are true
  HPU Health is OK (Green)
```

Fru Hydraulics Health

```
If Water Supply Alarm is True (obj_id 5011)
  FRU Health is Not OK (Orange)
If Glycol Supply Alarm is True (obj_id 5012)
  FRU Health is Not OK (Orange)
If Concentrate Supply Alarm is True (obj_id 5013)
  FRU Health is Not OK (Orange)
If Low Mixed Fluid Supply Alarm is True (obj_id 5014) Or Empty
Mixed Fluid Alarm is True
  (obj_id 5015)
  FRU Health is Not OK (Orange)
If None of the above conditions are True
  FRU Health is OK (Green)
```

ERA Health (Coincides with FIG. 16)

```
For each Pod (Blue and Yellow)
  If Corrected Stack X angle is less than low alarm limit or greater than high alarm limit
  (defaults: low: −5, high: 5)
    ERA Health is Not OK (Orange)
  If Corrected Stack Y angle is less than low alarm limit or greater than high alarm limit
  (defaults: low: −5, high; 5)
    ERA Health is Not OK (Orange)
  If Corrected Flexjoint Angle X is less than low alarm limit or greater than high alarm
  limit (defaults: low: −5, high: 5)
    ERA Health is Not OK (Orange)
  If Corrected Flexjoint Angle Y is less than low alarm limit or greater than high alarm
  limit (defaults: low: −5, high: 5)
    ERA Health is Not OK (Orange)
  If Gyroscope Validity value is equal to 0
      ERA Health is Net OK (Orange)
  If None of the above condition are True for Blue Pod And None of the above conditions are
    True for Yellow Pod
    ERA Heath is OK (Green)
```

Diverter Health

```
  For each Diverter Pressure Transducer
  (obj_ids 6201 through 6211)
      If value is less than low alarm limit Or value
  is greater than high alarm limit
      (default values listed below)
          Diverter Health is Not OK (Orange)
    If all pressure transducer values air within alarm limits
      Diverter Health is OK (Green)
  Default Pressure Transducer Alarm Limits: are listed as
  items 6201-6211 (nor shown)
```

That claimed is:

1. A system to visualize component health and preventive maintenance needs for subsea control subsystem components, the system comprising:

a blowout preventer (BOP) including one or more solenoid valves operably disposed within the BOP, each of the one or more solenoid valves configured to close upon energization of a respective one or more solenoids associated with the one or more solenoid valves, the BOP further including a plurality of downchain BOP components, one or more of the plurality of downchain BOP components being activated following energization of the respective one or solenoids associated with the one or more solenoid valves, the BOP further including a pair of control pods to control downchain BOP components, the pair of control pods including an active pod and a non-active pod;

one or more pressure tranducers disposed with the BOP, operably connected to each of the plurality of downchain BOP components associated with the BOP, and configured to indicate activity of individual downchain BOP components;

one or more processors; and tangible computer-readable medium in communication with the one or more processors and having stored therein a plurality of operational modules, each including a set of instructions that when executed cause the one or more processors to perform operations, the plurality of operational modules including:

a solenoid energization detection module responsive to the energization of the one or more solenoids and configured to detect a solenoid firing event upon energization of the one or more solenoids, a datalogger module responsive to the solenoid energization detection module and configured to log the solenoid firing event in a datalogger, a control pod status module configured to determine which of the pair of control pods is the active pod and which is the non-active pod, an event detection module responsive to the datalogger module, the control pod status module, and indications obtained from one or more pressure transducers and configured to detect a type of solenoid firing event, the type of solenoid firing event including one of a dry test, a wet test, and an actual event, a cycle count module responsive to the solenoid energization detection module and the event detection module and configured (a) to increment a cycle count for the solenoid and each of the plurality of downchain BOP components in a chain of hydraulic component activation associated with a predefined BOP function if the solenoid firing event is detected as a wet test or an actual event, and (b) to increment a cycle count for the solenoid and each of a subset of the plurality of downchain BOP components in the chain of hydraulic component activation associated with a predefined BOP function if the solenoid firing event is detected as a dry test;

a maintenance module responsive to the cycle count module and configured to provide a difference between (a) a cycle count for the one or more solenoids and a replacement cycle count for the one or more solenoids, and (b) a cycle count for any of the plurality of downchain BOP components and a replacement cycle count any of the plurality of downchain BOP components, the difference indicating to a user a number of cycles remaining before the one or more solenoids or any of the plurality of downchain BOP components should be replaced; and an automated alert module responsive to the maintenance module and configured to automatically display an alert on one or more displays, the alert providing cycle component parameter information including one or more of a solenoid overcurrent, a solenoid undercurrent, excessive fluctuation in solenoid current, excessive pressure in the regulators, and abnormal behavior in a pressure transducer or another BOP component.

2. The system of claim 1, further comprising a communications network, one or more vessels, and one or more on-shore management stations, the one or more vessels including one or more shipboard computers, the one or more on-shore management stations including one or more subsea control system asset management servers, the one or more shipboard computers and the one or more subsea control system asset management servers configured to communicate with one another via the communications network thereby to permit transfer of subsea control system asset information between the one or more shipboard computers and the one or more subsea control system asset management servers, wherein the plurality of downchain BOP components including one or more of shear seal valves, sub-plates mounted (SPM) valves, multiple position locking (MPL) components, flow meters, high-temperature and high-pressure probes, transducers, ram packers, packing units, shuttle valves, and regulators.

3. The system of claim 2, wherein the event detection module includes a detection algorithm responsive to pressure indications obtained by the one or more pressure transducers operably connected to the plurality of downchain BOP components.

4. The system of claim 3, wherein the detection algorithm includes:

for SPM valves pressurized at a predefined first pressure, (a) detecting a dry test if pod pilot pressure is zero or below a predefined threshold and (b) detecting a wet test or an actual event in the alternative;

for SPM valves pressurized at a predefined second pressure higher than the predefined first pressure, (a) detecting a dry test if the one or more pressure transducers read zero and (b) detecting a wet test or actual event in the alternative; and for all other downchain BOP components, (a) detecting a dry test if the pod pressure is zero or below a predefined threshold and (b) detecting a wet test or an actual event in the alternative.

5. The system of claim 2, wherein the event detection module includes a detection algorithm responsive to changes in a flowmeter value.

6. The system of claim 2, wherein the cycle count module is further responsive to the control pod status module, the cycle count module being further configured to increment a cycle count for the one or more solenoids and every downchain BOP component in a hydraulic chain down to and including the ram packer or packing units for the active pod, and to increment a cycle count for the one or more solenoids and every downchain BOP component in a hydraulic chain down to and including the SPM valves for the non-active pod.

7. The system of claim 1, wherein the maintenance module is further configured to provide a projected replacement date for each of the one or more solenoids and the plurality of downchain BOP components, each projected replacement date calculated using one or more of average historical usage, anticipated usage based on time of year, and anticipated usage based on type of activity being performed on the well.

8. The system of claim 7, wherein the plurality of modules further includes a dashboard module responsive to the maintenance module and configured to provide for display of a plurality of dashboard pages on one or more displays, the plurality of dashboard pages providing a graphical representation of BOP activity including a condition status for each of the one or more solenoids and the downchain BOP components and pressure indications from the one or more pressure transducers.

9. The system of claim 8, wherein the maintenance module is further configured to generate reports of suggested downchain BOP components to replace responsive to user-defined thresholds for each of the downchain BOP components.

10. The system of claim 9, wherein the BOP comprises a first BOP of a plurality of BOPs, the plurality of modules further including a fleet analytics module configured to provide a side-by-side comparison of like data collected by each of the one or more vessels, each of the one or more vessels configured to collect solenoid firing event data and downchain BOP component activity data from the plurality of BOPs.

11. The system of claim 7, wherein the alert further provides cycle count information.

12. The system of claim 11, wherein the cycle count information comprises one or more of the cycle count of the one or more solenoids or any of the downchain BOP components reaching a predefined threshold, the cycle count of the one or more solenoids or any of the downchain BOP components coming within a predefined number of a predefined threshold, the projected replacement date for one or more solenoids or any of the downchain BOP components being reached, and the projected replacement date for the one or more solenoids or any of the downchain BOP components being a predefined number of days in the future.

13. A method to visualize component health and preventive maintenance needs for subsea control subsystem components, the method comprising:

providing one or more solenoid valves within a blowout preventer (BOP), the one or more solenoid valves configured to close upon energization of a respective one or more solenoids associated with the one or more solenoid valves;

providing one or more pressure transducers operably connected to a plurality of downchain BOP components, one or more of the plurality of downchain BOP components configured to activate following energization of the respective one or more solenoids associated with the one or more solenoids valves, the one or more pressure transducers configured to indicate activity of individual downchain BOP components;

detecting a solenoid firing event responsive to energization of the one or more solenoids;

logging the solenoid firing event in a datalogger;

determining which of a pair of control pods is an active pod and which is a non-active pod;

detecting whether the solenoid firing event represents a dry test, a wet test, or an actual event responsive to indications obtained from one or more pressure transducers;

incrementing a cycle count for the one or more solenoids and each of the plurality of downchain BOP components in a chain of hydraulic component activation associated with a predefined BOP function if the solenoid firing event is detected as a wet test or an actual event;

incrementing a cycle count for the one or more solenoids and each of a subset of the plurality of downchain BOP components in the chain of hydraulic component activation associated with a predefined BOP function if the solenoid firing event is detected as a dry test;

providing a difference between a cycle count for the one or more solenoids and a predefined replacement cycle count for the one or more solenoids;

providing a difference between a cycle count for any of the plurality of downchain BOP components and a predefined replacement cycle count for any of the plurality of downchain BOP components, the differences indicating to a user a number of cycles remaining before the one or more solenoids or any of the plurality of downchain BOP components should be replaced; and automatically displaying an alert on one or more displays, the alert providing cycle component parameter information including one or more of a solenoid overcurrent, a solenoid undercurrent, excessive fluctuation in solenoid current, excessive pressure in the regulators, and abnormal behavior in a pressure transducer or another BOP component.

14. The method of claim 13, further comprising the step of transferring subsea control system asset information over a communications network between one or more shipboard computers located on one or more vessels and one or more subsea control system asset management servers located at one or more on-shore management stations, wherein the plurality of downchain BOP components include one or more of shear seal valves, sub-plate mounted (SPM) valves, multiple position locking (MPL) components, flow meters, high-temperature and high-pressure probes, transducers, ram packers, packing units, shuttle valves, and regulators.

15. The method of claim 14, wherein detecting whether a solenoid firing event is a wet test, a dry test, or an actual event is responsive to pressure indications obtained from the one or more pressure transducers operably connected to the plurality of downchain BOP components.

16. The method of claim 14, wherein detecting whether a solenoid firing event is a wet test, a dry test, or an actual event is responsive to changes in a flowmeter value.

17. The method of claim 14, further comprising:

for the active pod, incrementing a cycle count for the one or more solenoids and every downchain BOP component in a hydraulic chain down to and including the ram packer or packing units; and for the non-active pod, incrementing a cycle count for the one or more solenoids and every downchain BOP component in a hydraulic chain down to and including the SPM valves.

18. The method of claim 13, further comprising providing a projected replacement date for each of the one or more solenoids and the plurality of downchain BOP components, each projected replacement date calculated using one or more of average historical usage, anticipated usage based on time of year, and anticipated usage based on type of activity being performed on the well.

* * * * *